US005815143A

United States Patent [19]

Jenney et al.

[11] Patent Number: 5,815,143

[45] Date of Patent: Sep. 29, 1998

[54] VIDEO PICTURE DISPLAY DEVICE AND METHOD FOR CONTROLLING VIDEO PICTURE DISPLAY

[75] Inventors: Warren Kimberly Jenney; Randy Minobe, both of San Jose, Calif.; Tomohisa Koyiyama, Kanagawa-ken, Japan; Masami Yamagishi, Kanagawa-ken, Japan; Takahiro Yamada, Kanagawa-ken, Japan; Munekazu Kamo, Kanagawa-ken, Japan; Makoto Noumi, Ibaragi, Japan; Noriyuki Iwai, Kanagawa-ken, Japan

[73] Assignee: Hitachi Computer Products (America), Santa Clara, Calif.

[21] Appl. No.: 634,117

[22] Filed: Apr. 17, 1996

Related U.S. Application Data

[63] Continuation of Ser. No. 136,327, Oct. 13, 1993, abandoned.

[51] Int. Cl.[6] ..... G09G 5/36

[52] U.S. Cl. ..... 345/191; 345/509; 345/340

[58] Field of Search ..... 345/112, 113, 345/115, 118, 119, 120, 185, 189, 191, 203, 501, 507, 509, 523, 340, 342; 395/501, 507, 509, 523, 340, 342, 520

[56] References Cited

U.S. PATENT DOCUMENTS

| | | | |
|---|---|---|---|
| 5,222,159 | 6/1993 | Kawamura et al. | 382/283 |
| 5,229,852 | 7/1993 | Maietta et al. | 348/441 |
| 5,469,541 | 11/1995 | Kingman et al. | 395/509 |
| 5,557,302 | 9/1996 | Levinthal et al. | 345/189 |

*Primary Examiner*—Matthew M. Kim
*Assistant Examiner*—U. Chauhan
*Attorney, Agent, or Firm*—Flehr Hohbah Test Albritton & Herbert LLP

[57] ABSTRACT

A video picture written in the bit map memory (4) is displayed in a predetermined area on the display screen (70) of the display device (7) within the computer main body (100). The masking memory (2) having a bit number equal to or less than the number of the pixels of the video picture to be inputted is provided separate from the bit map memory (4). When the pixel data of the video picture data has been inputted, the input pixel data is selectively written in the bit map memory (4) based on the contents of the masking memory (2). In displaying a compressed picture of the input video picture on the display screen, an oblique line generating algorithm is used.

29 Claims, 20 Drawing Sheets

A. WHEN n=6

B. WHEN n=13

VIDEO PICTURE DISPLAY DEVICE AND METHOD FOR CONTROLLING VIDEO PICTURE DISPLAY

This application is a continuation of application Ser. No. 08/136,327, filed Oct. 13, 1993, now abandoned.

BACKGROUND OF THE INVENTION

The present invention relates to a picture display device known as a scan converter, and relates more particularly to a video picture display device which is suitable for displaying an inputted video picture on a display screen of a computer equipped with a window environment.

The scan rate of a display screen of a personal computer (hereinafter to be abbreviated as a "PC") or a work station (hereinafter to be abbreviated as a "WS") which is used as a computer is generally different from that of a screen of a television set or the like. Therefore, a video picture display device for displaying a video picture on the display screen of the PC or the WS by combining video pictures of a television set or the like requires a change of the scan rate. Accordingly, the video picture display device is also called a scan converter.

Normally, the scan converter stores data of a video signal in a video memory which is a memory unit (also called a frame memory). In the present specification, the scan converter memory will hereinafter be called a "video VRAM (video random access memory)" in order to distinguish between this memory unit and a video memory for graphics which is located in the computer such as a PC and a WS. A read control unit within the scan converter (a graphics display unit) reads data within the video to match a display timing signal at the computer side and a picture change over control unit suitably changes over between read data from she video and read data for graphics display at the computer side and send the data to the display device. Thus, video pictures of the television or the like are combined for display on the display screen of the computer. Generally, a CRT display or a liquid crystal panel is used as a display device of the computer such as a PC or a WS.

In recent years, great importance has come to be attached to an application for monitoring a television broadcasting program or for displaying a dynamic picture or a still picture such as animation pictures, for example, on the display device of the computer. An application for displaying various kinds of pictures as described above will be called a multi-media application in the present specification.

In the mean time, along with the improvement in the performance of a processor for controlling a computer system as a whole and an increase in the capacity of the main memory loaded in the computer, a system environment as represented by a window system (hereinafter to be referred to as a "window environment") has come to be employed extensively in recent years. Under this window environment, a user opens (or displays) at least one window on the screen of the display device to have a display of a desired application program within that window. Multiple windows each with a desired application may also be opened.

Based on the window environment, a multiple video pictures can be displayed simultaneously on a single screen so that this window environment can be combined with a multi-media application in a very suitable manner. Since the user can open a plurality of windows at desired positions on the screen of the display device under the window environment; a case exists, however, where windows may be superposed with each other. For example, when two windows are partly superposed, the rear side window portion which is hidden by the front window needs to be controlled not to be displayed.

When a multi-media application operates in the window environment, there arises such a case that a video picture is displayed within a window behind multiple windows which in turn are partly superposed on each other such that a part of the video picture can not be displayed. Since the video picture data is being stored within the video VRAM which is separate from the graphics video memory, as mentioned above, it is necessary to have some skill to read video picture data in order to make a display of the video picture (particularly a dynamic picture) that has such an undisplayed portion as described above.

Broadly, two methods are known as methods for obtaining a video picture which has a partly hidden portion.

One method is to control the writing of video VRAM such that the partly hidden portion of the video picture data is not written to video VRAM. This method will be called a writing mask control system in the present specification.

The other method is to control the video VRAM, at the time of reading video picture data from the video VRAM, so as to select and display either video picture data read from the video VRAM or graphics data read from the graphics video memory. This method will be called a keying control system in the present specification.

A conventional writing mask control system is disclosed in the "Nikkei Electronics", Jun. 24, 1991 issue (No. 530), pp. 165–176. In the above literature, a 16-plane video memory is disclosed which combines the graphics video memory and the video into one. One of the 16 planes is used as a writing mask plane for video picture data and the remaining 15 planes are allocated to either the video or the graphics video memory.

Based on this structure, before writing video picture data into the planes that have been allocated to the video VRAM, it is necessary to read mask data of the mask plane and check for each dot data of the video picture to see whether the corresponding dot data is writable or write prohibited in the video VRAM planes. If the mask data that has been read shows a write permit, the corresponding dot data is written in the video VRAM planes, and otherwise the data is abandoned.

Under the above-described structure, the writing mask data required is equivalent to the number of pixels that constitute the display screen of the computer display device. For example, when the display screen of the display device is structured by pixels of 1280×1024, minimum 1280×1024×1 bits are necessary and since the mask plane is structured by combining a plurality of general semiconductor memory devices, 2048×1024×1 bits are necessary in total. This corresponds to two semiconductor memory devices of one megabits.

On the other hand, in the case of a video signal of a television set, generally the video signal is digitally sampled by about 640×480 pixels in the case of the NTSC system. Accordingly, it is a waste of the memory to prepare, for one kind of video picture, pixels of the number corresponding to that of the display screen of the display device. In the case of installing a scan converter function in the computer such as a PC or a WC, this style of an option board is taken most. Such an option board is required to be low in price, take small space for loading and consume low energy.

FIG. 3 schematically shows, in the structure of the video memory of the above-described literature, video picture data stored in the graphics display device and then displaying of the video picture data on the display screen of the computer where a part of the video picture data is hidden by the other window.

FIG. 3 shows display screen 70 of the display device of a computer. In the display, a window 71 for displaying a video picture and a graphics display window 72 are partly superposed with each other on the display screen 70. In mask plane 20, a mask pattern as shown has been written in advance by a processor (not shown) within the computer by referring to information relating to the layout of windows of the display screen.

In the mask plane 20, hatched area 21 corresponds to window 71 for displaying a video picture in display screen 70, thus mask information (1 bit, for example "0") for this portion permits writing of video picture data in the video VRAM plane. Mask information (1 bit, for example "1") in area 23 prohibits writing of video picture data in the video VRAM plane.

Area 22 includes cut portion 23 which corresponds to the portion of window 71 hidden by window 72 on display screen 70.

Area 10 represents the memory capacity (640×480 pixels) of the video picture data. The video picture data is sequentially written to the address corresponding to window 71 on display screen 70 of the video VRAM plane. In this case, writing of the part of the video picture data corresponding to cut portion 23 is prohibited by the mask information.

As described above, a video picture can be cut within the structure of the video memory of the above-described literature. However, the literature does not address the problem of simultaneously displaying multiple video pictures on the display screen. The mask plane requires masking memory capacity equivalent to that of the pixels on the display screen of the computer. Moreover, the mask memory and the video picture data are written within the same memory and that only one bit (1 plane) is provided as mask information of the mask plane.

Furthermore, the structure of the above-described literature, does not discuss scaling, also referred to as expansion or compression, of a dynamic picture following an expansion or a compression of the window. Thus, the size of the dynamic picture will not change even if the sizes of the window have been changed.

The write control unit process for controlling the writing of input video picture data into the video VRAM plane, requires the write control unit to generate a two-dimensional address. The method of generating the address becomes complex for scaling a video picture on the display screen or to carry out a reversed display, that is an inversion of up or down and right and left, or both of the video picture by applying a special effect. In the case of scaling, the structure will become more complex when mitigating an alias (a jaggedness in the display).

Additionally, when the user changes the shape of the window on the display screen, the mask pattern data of the mask plane in the conventional video memory, must be updated (rewritten) in accordance with this change. However, if video picture data of the video VRAM plane has been rewritten during the updating of the mask pattern data the video picture which is displayed becomes unnatural because considerable updating time is required. In general, while updating the mask pattern data, stopping of the writing of the video picture data is possible. However, when the video picture is a dynamic picture, a stop motion results during the write stopping period.

Finally, when the user changes the shape of the window, the video picture data is written in a new window. In this case, if the last video picture data displayed in the window has not been deleted properly, the video picture data remains as a so-called "garbage data" in the display screen and the video VRAM plane, thus causing an undesired effect.

SUMMARY OF THE INVENTION

It is an object of the present invention to provide a video picture display device and a method for controlling the video picture display suitable for displaying a video picture in a computer system which employs a window environment.

It is another object of the present invention to provide a video picture display device and a method for controlling the video picture display which can perform a multiple picture processing despite a relatively simple structure.

In order to achieve the above-described objects, according to the preferred embodiments of the present invention, a write mask memory is provided independent of video VRAM in the video picture input unit and the mask data of the write mask memory corresponds to the number of pixels comprising the video picture.

Furthermore, two write mask memories may be provided in the video picture input unit so that these write mask memories are rewritten at each end of video picture signal.

Additionally, the write mask data of the write mask memory may be divided into groups for each scanning line of relevant video picture input and information relating to the position of the display screen and picture processing may be added to each group.

DESCRIPTION OF THE PREFERRED EMBODIMENTS

A first embodiment of the present invention is explained with reference to FIG. 1 and FIG. 2.

Figure 1:
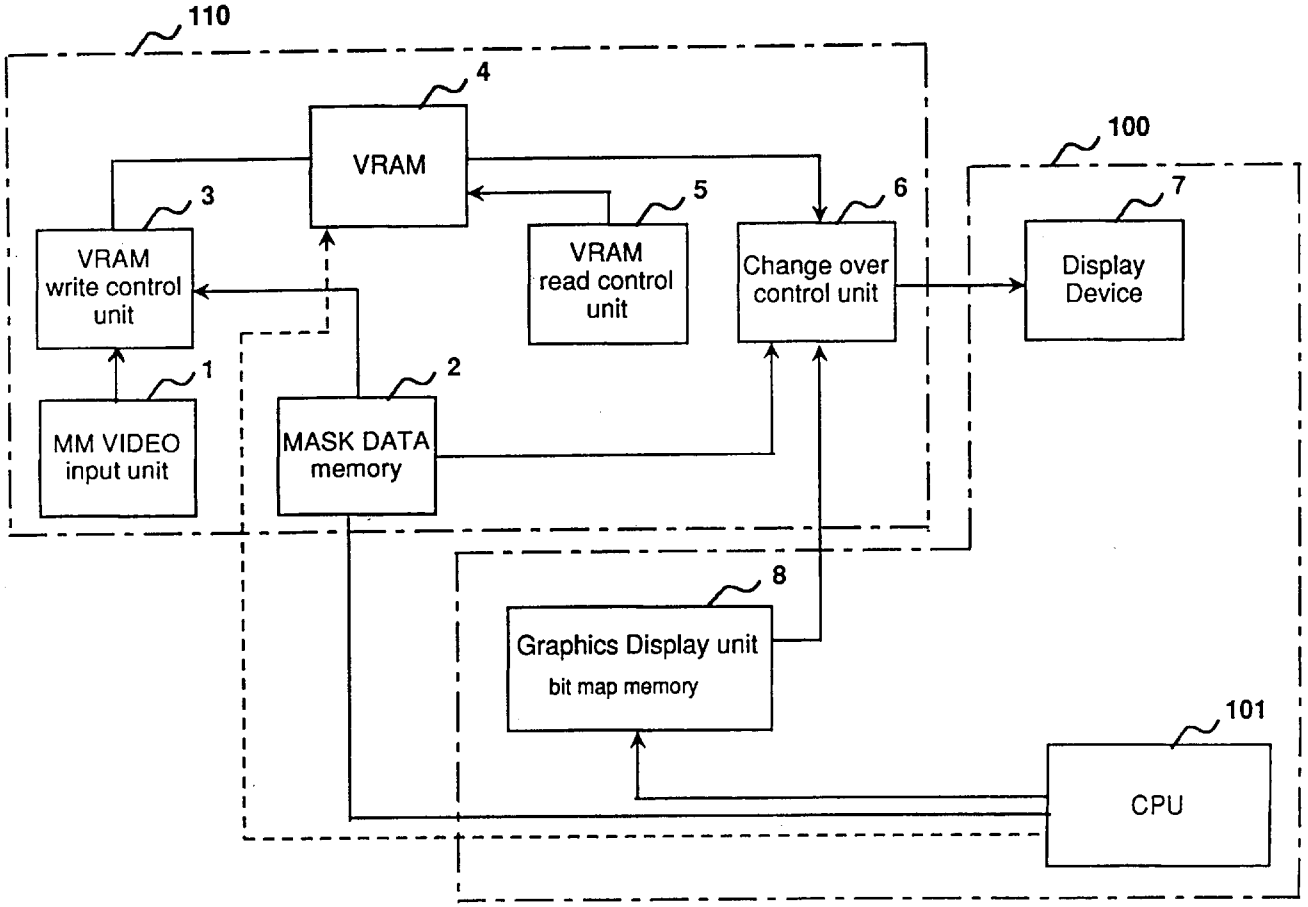
FIG. 1 is a schematic diagram of a first embodiment of the present invention.
Figure 2:
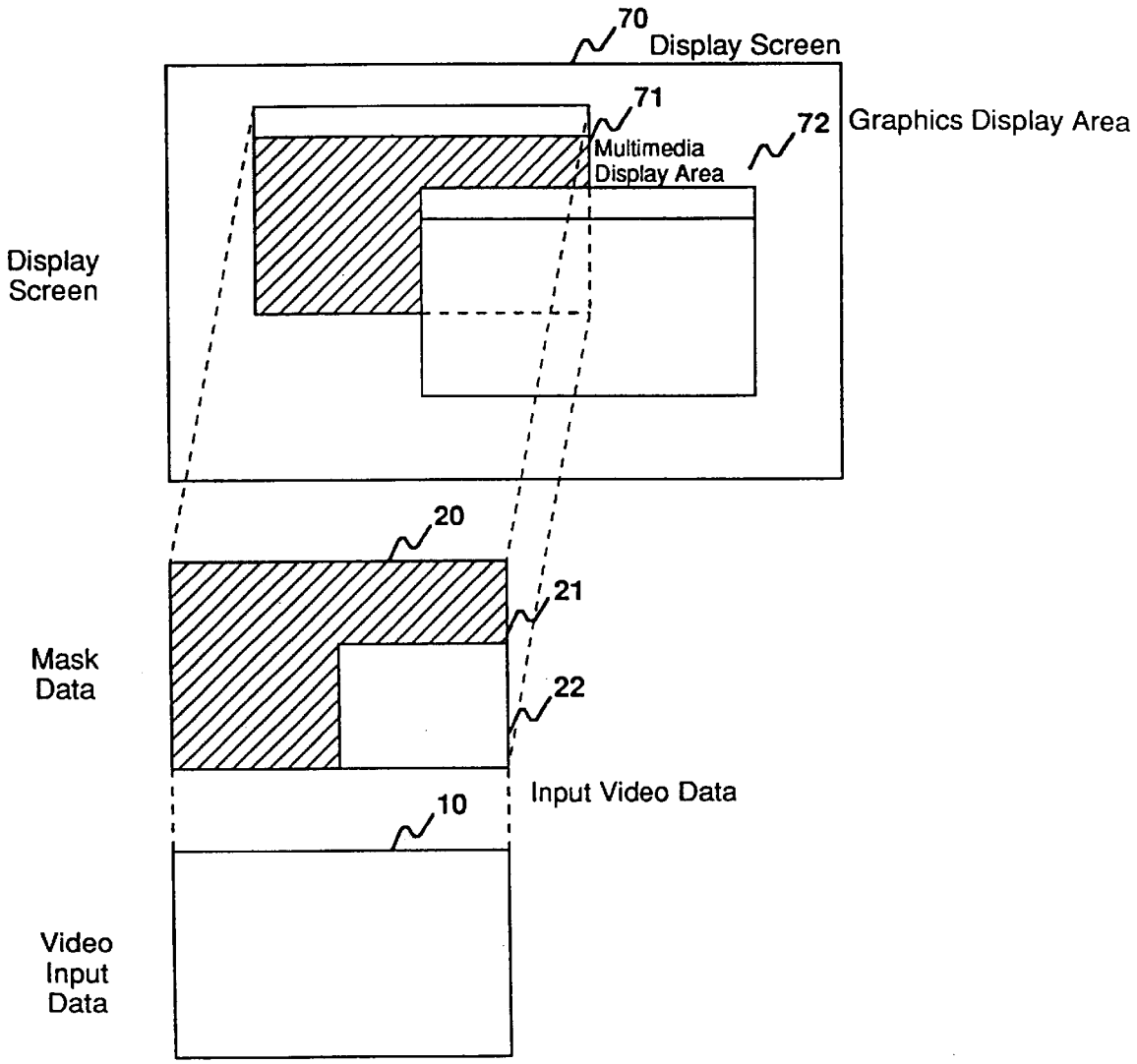
FIG. 2 is an illustration diagram of the display process according to the present invention.
Figure 3:
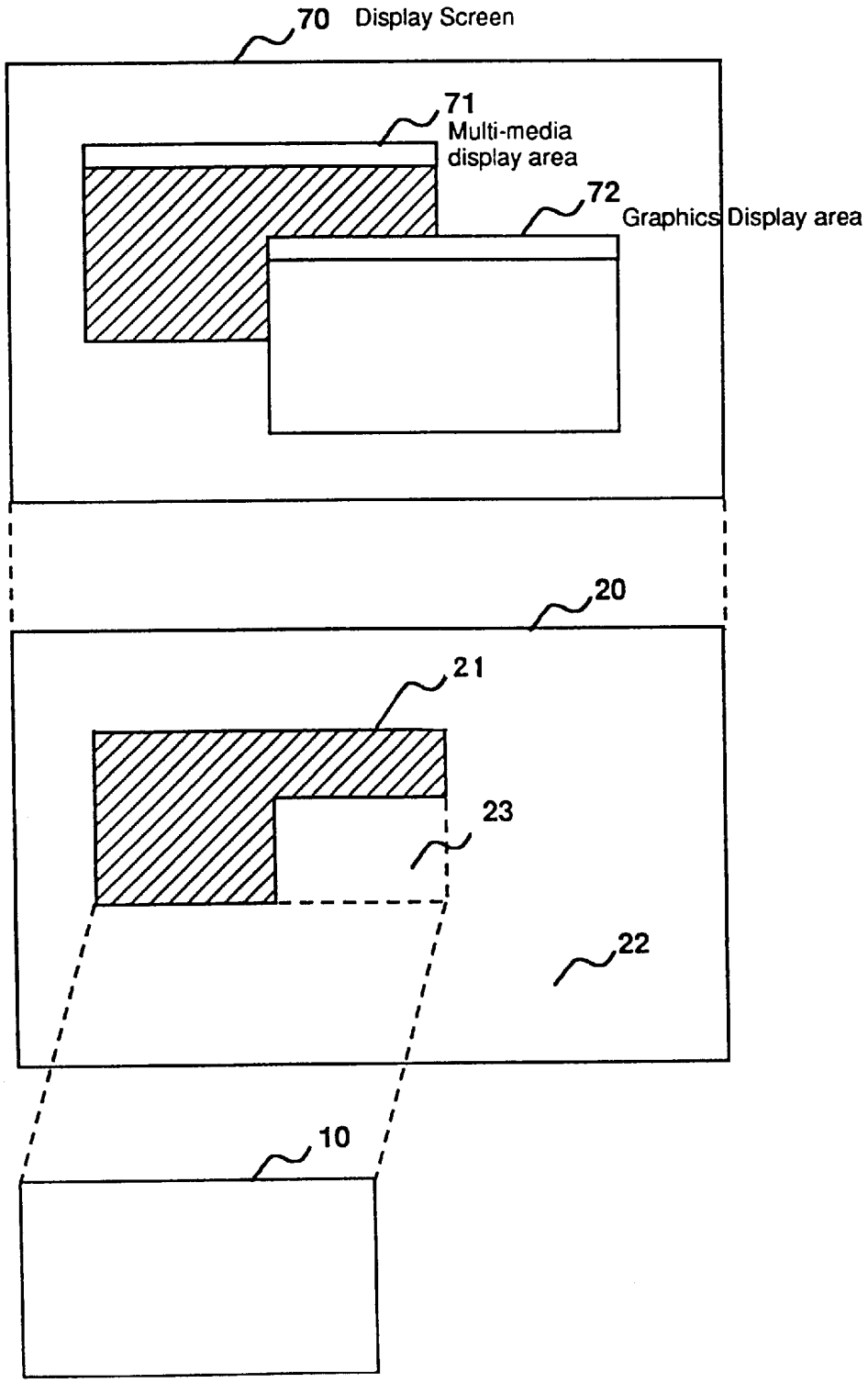
FIG. 3 is an illustration diagram of the display operation according to the prior art technique.

FIG. 1 is a schematic diagram of the first embodiment of the present invention and FIG. 2 illustrates the display process for a multi-media video picture. Referring to FIG. 1, 110 designates a video picture display device, 1 an input unit of multi-media video picture data such as either a dynamic picture or a still picture, 3 a write control unit of a video VRAM 4, 2 a mask data storing memory, containing both write mask and keying plane data 5 a read control unit of video VRAM 4, 8 a graphics display unit within a computer main body 100 where graphics display unit 8 includes a memory of a bit map corresponding to the pixels of the display screen of display device 7, 6 a change-over control unit for controlling pictures between the multi-media picture output of video VRAM 4 and the graphics display output of graphics display unit 8, 7 a display device within the computer main body 100, and 101 designates a CPU within the computer main body 100. FIG. 2 explains the data flow up to the stage where input data 10 of picture data input unit 1 is displayed on display screen 70 of display device 7.

Mask data storing memory 2 in FIG. 1 has write mask bits corresponding to the number of pixels of input video picture data 10, and it is assumed that data as shown by write mask data 20 in FIG. 2 has been written in advance in mask data storing memory 2 by CPU 101 within the main body. In FIG. 2, hatched area 21 corresponds to a data display area (or a window) 71 for the multi-media video picture data on display screen 70 of display device 7. Hatched area 21 is filled with write mask cancellation information for writing input video picture data 10 in video VRAM 4. Area 22 corresponds to the portion of graphics data display area 72 overlap, multi-media data display area 71 in the display screen 70, and this area is filled with write mask information which disables writing input data 10 in video VRAM 4.

Write control unit 3 sequentially reads in advance the address of the mask data storing memory corresponding to the input video picture data 10. If the contents of the address is a write mask cancellation (area 21), the write control unit 3 operates so that the input data 10 is written in video VRAM 4 and if the contents of the address is a write mask enable (area 22), write control unit 3 operates so that the input video picture data 10 is not written in the video VRAM 4. In other words, write control unit 3, which assigns the write position (address) to video VRAM 4, reads the write mask data of masking memory 2 corresponding to the pixels of the video picture data and controls the writing by deciding whether the pixels are to be written in the VRAM 4 according to the contents of the write mask data. Based on this control, the input video picture data is clipped in the shape written in advance in the mask memory 2.

In general, television video signals are digitally sampled approximately as 640×480 pixel size as in the NTSC system, for example. According to the present invention, if a write is available that has at most the capacity of the number of bits equal to that of the digital sample (for example 640×480), it is possible to display the picture in a shape of a desired write area at a desired position even if the video VRAM has a bit map (for example, 1280×1024) larger than the number of digital sample. In comparing the write mask memory of this system with the above-described prior-art technique, write mask memory 2 shown in FIG. 1 requires a capacity of at most the number of the bits equal to that of the digital sample of the input video picture data, while the masking plane of the prior-art technique is integrated with the graphics VRAM thus the prior art masking plane requires the bit map of the size equal to that of the pixel structure of the display screen of the display device.

If write mask memory 2 allocates one bit to digital sample data of two pixels of an input video picture, it is possible to further reduce the capacity of the write masking memory 2 to one half. To be more specific, when a video picture input is digitized in the display system of YUV (luminance, color difference 1, color difference 2) instead of RGB (red, green, blue), for example, the color difference component of the UV is sub-sampled. In this case, since the color difference components UV becomes input data for luminance component Y, it is more convenient to use two pixels as a unit for the write masking processing. Thus, it is possible to reduce the capacity of the write mask memory 2 to one half of the original capacity.

In general, when one bit of one-bit write mask memory has been allocated to n-pixel digital sample data, the capacity of the write mask memory 2 can be reduced to one n-th of the digital sample number of the input data. More specifically, when the color difference component has also been sampled in a vertical direction in the YUV display system, as described above, or when one set of color difference component UV becomes input data for the luminance component Y totalling four pixels, including two pixels both vertically and horizontally, it is more convenient to carry out the write masking processing based on four pixels as a unit. In this case, it is possible to reduce the capacity of write mask memory 2 to one quarter of the original capacity. As described above, according to the present embodiment, the capacity of write mask memory 2 can be minimized so that the cost relating to the memory can be reduced.

According to the prior-art technique, the masking plane has been integrated with the video VRAM and the graphics VRAM shared memory, this requires that video VRAM is read modified when the write masking processing is performed. However, when the write mask memory 2 is separated from video VRAM 4 as in the present embodiment, pipe line processing is possible by setting in parallel the reading of write mask memory 2 and the writing into video VRAM 4. Thus, the bus band width of video VRAM 4 is doubled when writing a video picture in video VRAM 4. Where the display of a multiple dynamic picture windows is necessary in the video picture display device, the maximum number of pictures that can be displayed simultaneously is increased.

As described above, in general a video signal such as a television signal is approximately 640×480 pixels as in the NTSC system, for example. According to the present invention, if a write mask memory having the capacity of at most the number of bits equal to the number of digital samples (for example 640×480) is available, it is possible to display a video picture in the shape of a desired write area at a desired position even for a video VRAM having a bit map (for example, 1280×1024) which is larger than the number of the digital samples. The designation of writing positions in the video VRAM is carried out by a unit for assigning the write position of the picture. The video picture is clipped to a shape written in advance in the write mask memory by a unit for reading the write mask memory according to the picture input and by a write control unit for controlling the writing by deciding whether the picture input should or should not be written in the VRAM according to the contents of the write mask memory.

Figure 4:
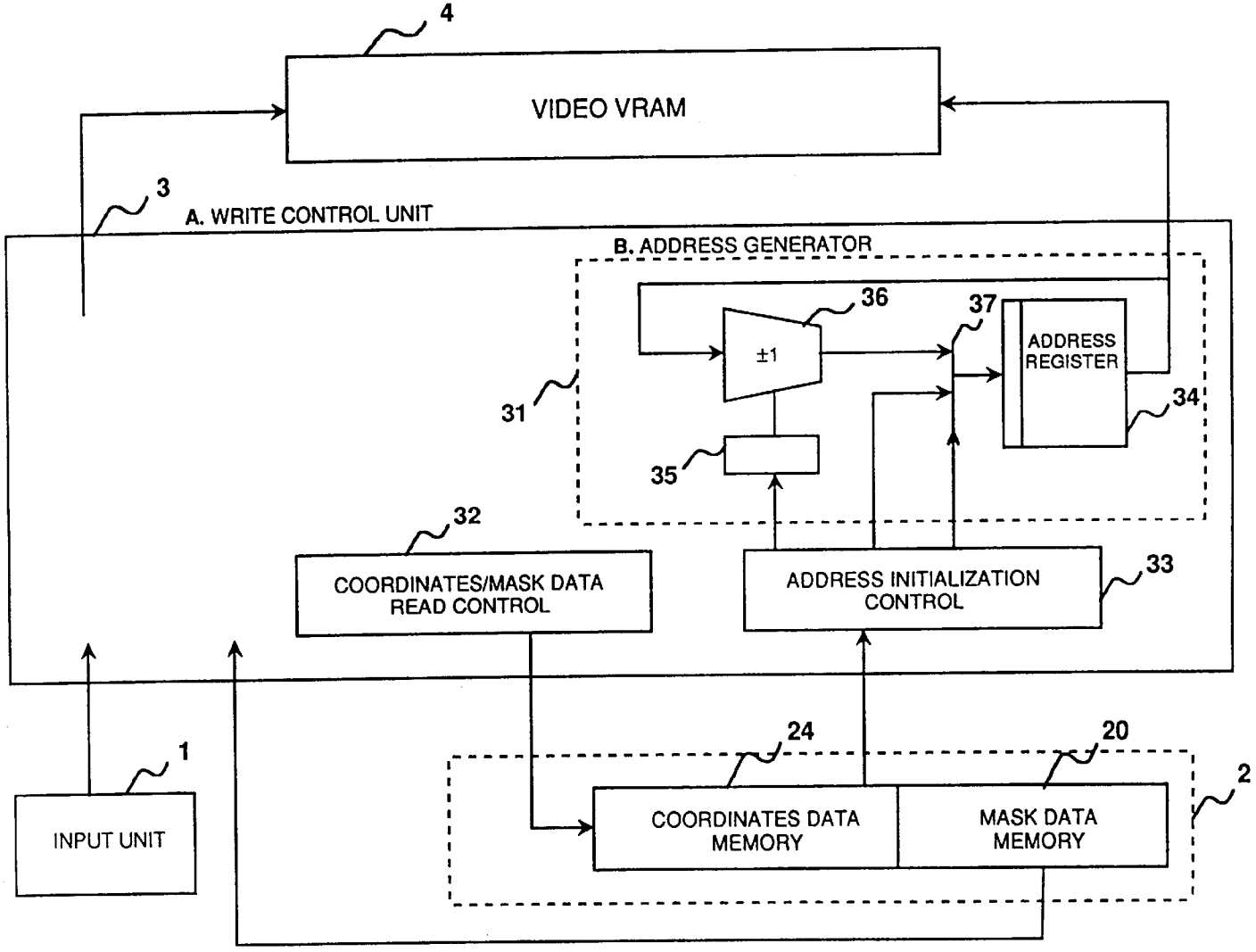
FIG. 4 is a schematic diagram of a second embodiment of the present invention.

A second embodiment of the present invention is explained next with reference to FIG. 4, FIG. 5, FIG. 6 and FIG. 7. FIG. 4 is a configuration diagram of the second embodiment of the present invention in which mask data storing unit 20 and coordinate data storing unit 24 are provided in mask memory 2. Referring to FIG. 4, 31 designates an address generating unit, 32 a unit for controlling the reading of coordinates/mask data, and 33 an address initialization control unit for the address generating unit 31. Address generating unit 31 includes address register 34, change-over unit 37, ± arithmetic unit 36 and ± arithmetic unit control register 35, as an example for generating a one dimensional writing address Other units are the same as those provided with the same symbol marks in FIG. 1.

Figure 5:
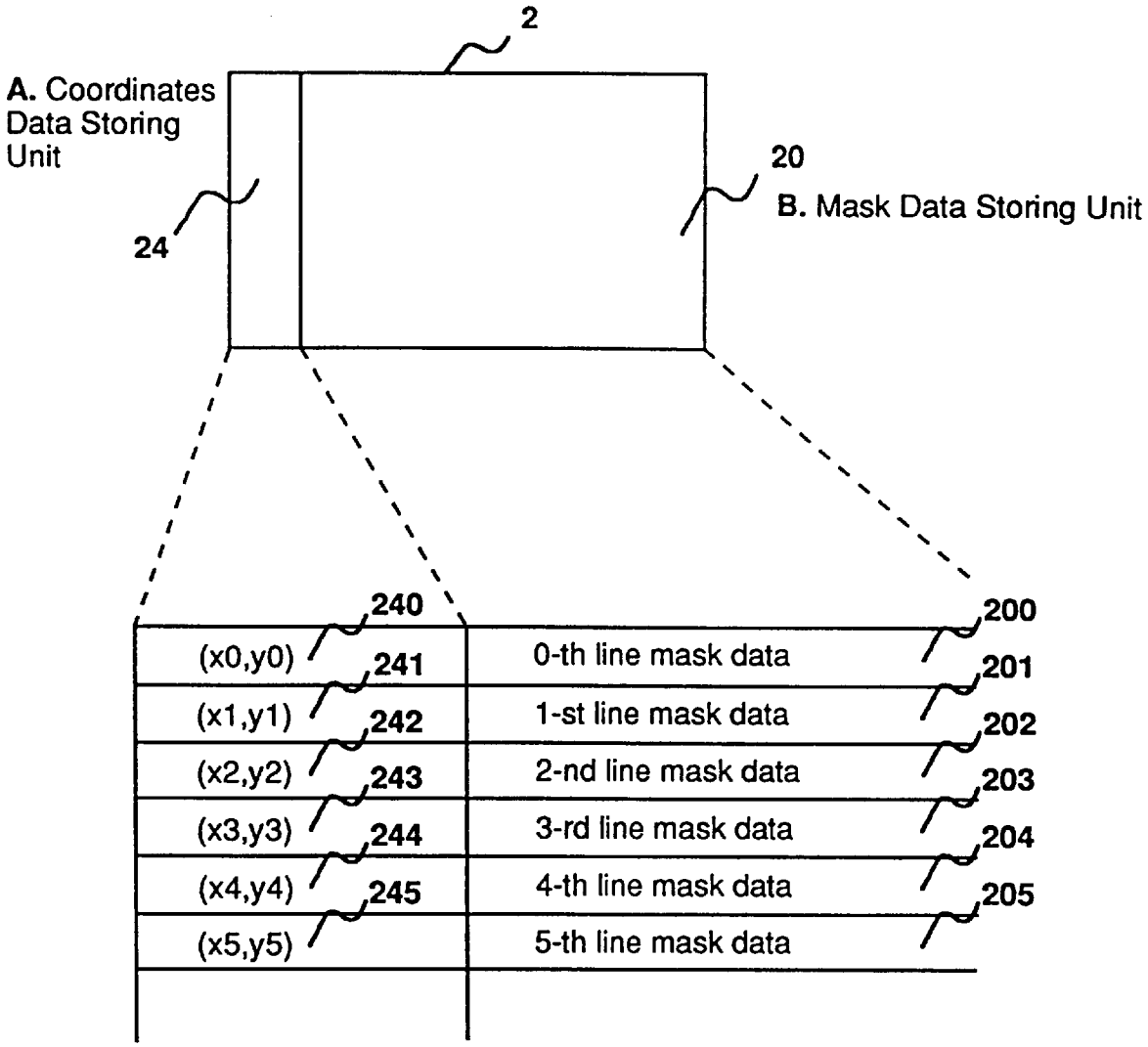
FIG. 5 is a schematic diagram of one example of the write mask memory structure.

FIG. 5 shows one example of the configuration of write mask memory 2. Coordinate data storing unit 24 in FIG. 5 stores the coordinate data (address) of video VRAM 4 for writing picture data for each horizontal scanning of the input video picture data. In coordinate data storing unit 24, CPU 101 in computer main body 100 stores in advance, as initial values, write starting coordinates (addresses) 240, 241, 242, 243, 244, 245, etc., corresponding to each horizontal line of the video picture input on display screen 70. In the master data storing unit 20 which follows the coordinate data storing unit 24, the CPU also stores in advance write masking information 200, 201, 202, 203, 204, 205, etc., for video VRAM 4 that are determined according to the shapes of windows on display screen 70.

Figure 6:
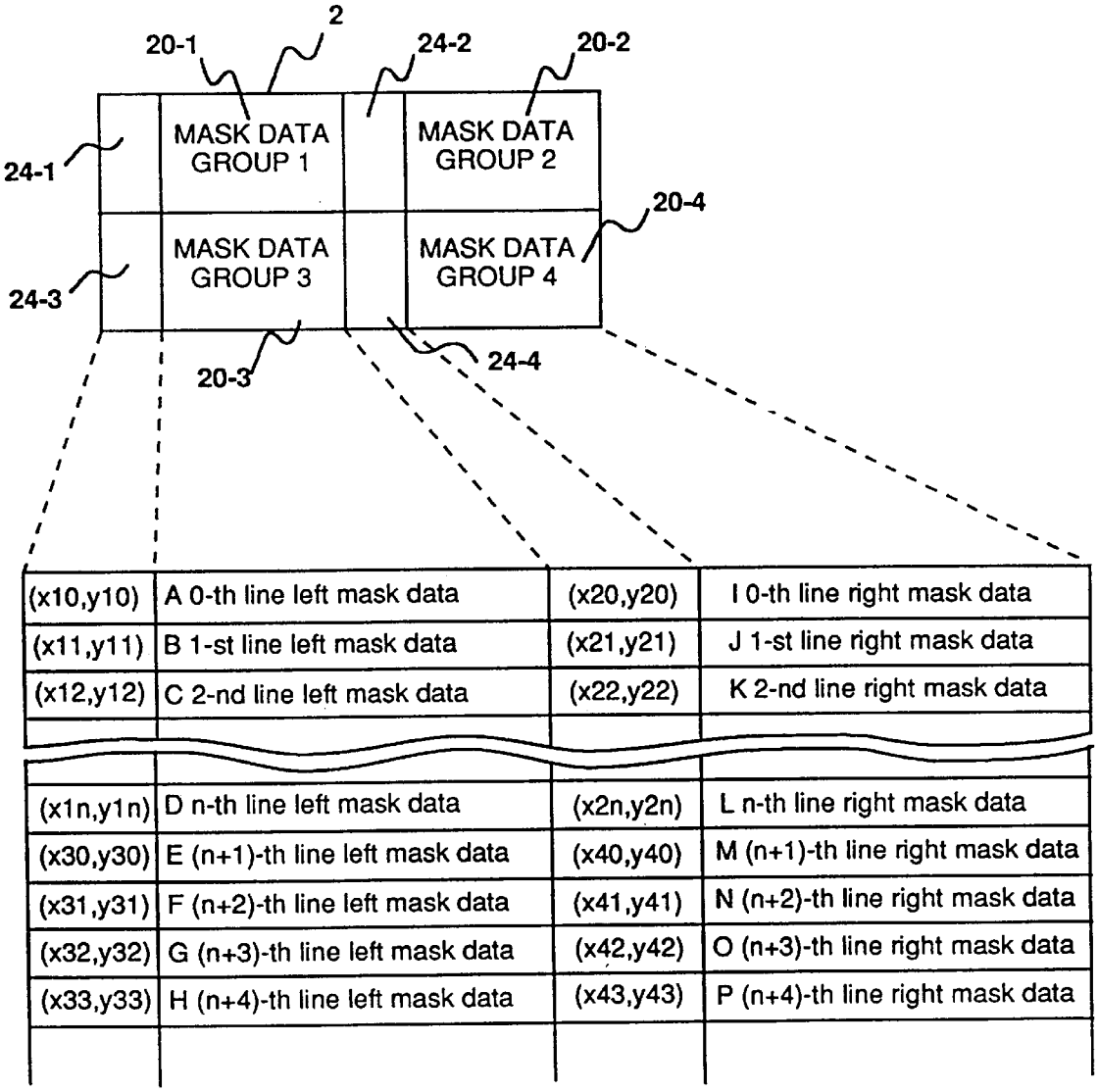
FIG. 6 is a schematic diagram of an example of the structure of the write mask memory when the window in the display screen is further divided.

FIG. 6 shows an example of an alternate configuration of write mask memory 2. In FIG. 6, CPU 101 within computer main body 100 writes data to write mask memory 2 when one window 71 on the display screen 70 is divided into four at the outset. In other words, the mask data within write mask memory 2 is divided into four mask data groups of 20-1, 20-2, 20-3, and 20-4, and coordinate data on video VRAM 4 is provided in each group for each horizontal scanning line of the video picture.

With this arrangement, when the video picture input is a result of a combination of a multiple video pictures, the divided window portions can be freely moved within the data write range of each video VRAM 4 when the coordinate data of each mask data is rewritten from the video picture display device side.

If window 71 is used as the original window, the coordinate data added to each group is determined so that the end of the left side mask data group is connected to the starting of the right side mask data group for each horizontal line of the input video picture. It is readily apparent to one skilled in the art that although FIG. 6 shows an example of one window divided into four, the window can be divided into any desired number.

Figure 7:
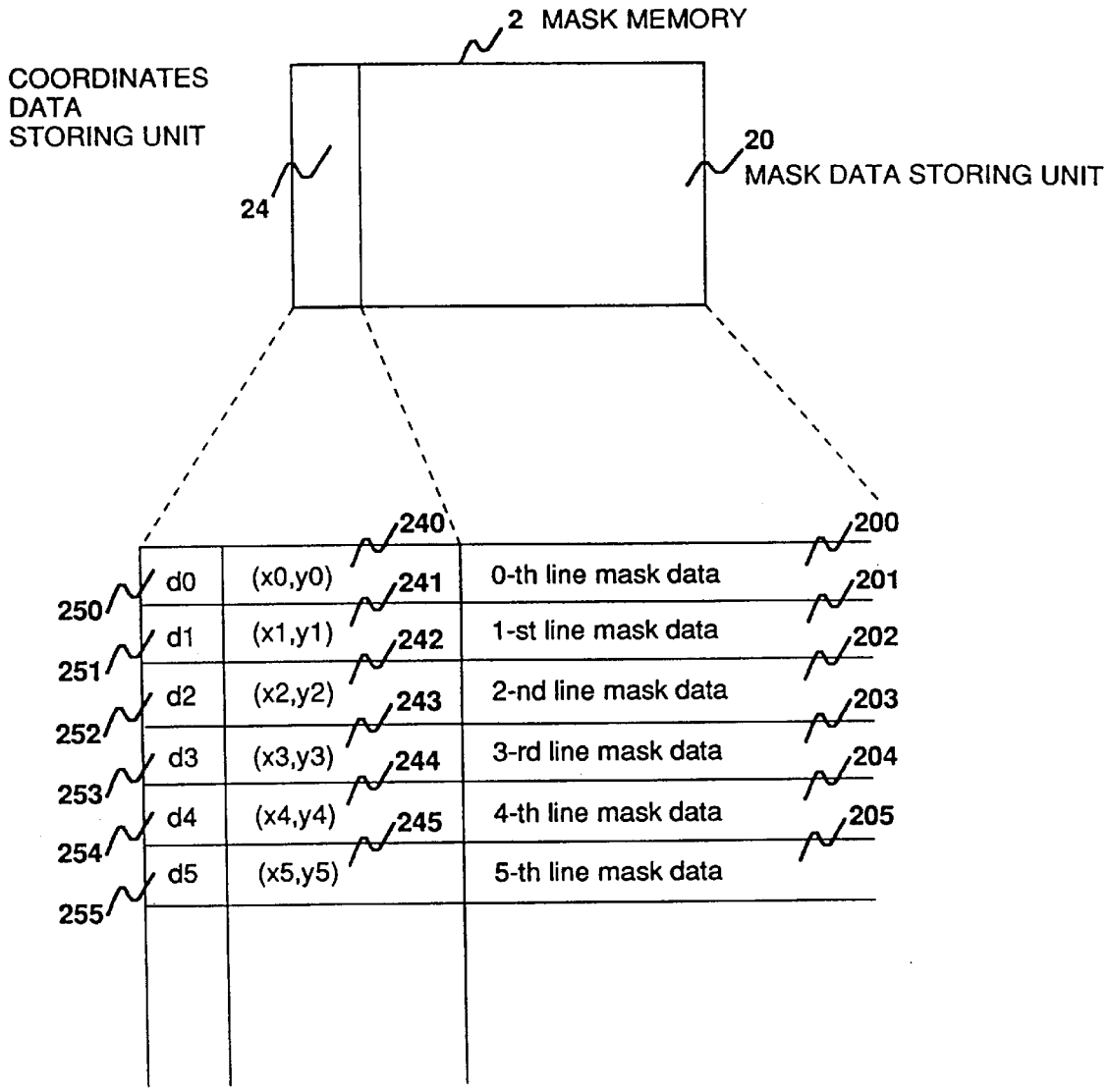
FIG. 7 is a schematic diagram of another example of the write mask memory structure.

FIG. 7 shows another example of the configuration of write mask memory 2. Address scanning directions of the horizontal line on video VRAM 4 are stored in coordinate data storing unit 24. The address scanning directions (direction flags 250, 251, 252, 253, 254, 255, etc.), which are generated by address generator 31, comprise either "+" (a scan in the right direction) or "−" (a scan in the left direction). The address scanning directions are stored in advance, along with the write starting coordinates (addresses) 240, 241, 242, 243, 244, 245, etc. corresponding to each horizontal line of the picture input on video VRAM 4. The contents of mask data storing unit 20 that follow the coordinate data storing unit 24 are the same as those explained with reference to FIG. 5.

The operation is explained next with reference to FIG. 4 and FIG. 7. Control unit 32, for controlling the reading of coordinates and mask data sequentially, reads one data line from coordinates memory storing unit 24 of write mask memory 2, that is, the direction control flag 250 and the write starting coordinates 24. The read data is input to address initialization control unit 33. Address initialization control unit 33 sets the contents of the direction control flag 250 in +arithmetic unit control register 35 and then sets the address based on the contents of write starting coordinates 240 in address register 34 based on change-over unit 37.

Then, control unit 32, which reads coordinates/mask data, controls whether or not the data from picture input unit 1 is to be written in video VRAM 4 by reading mask data 200. In synchronization with control unit 32, address generating unit 31 generates a write address to video VRAM by adding one to or deducting one from the contents of address register 34 according to the contents of direction control flag 250. The address is based on the contents of write starting coordinates 240 which sets the initial value. Thereafter, each time the processing for one line is completed, coordinate and mask data read controlling unit 32 continues the processing by reading the next direction control flag (e.g., 251), and write starting coordinates (e.g., 241) which correspond to the next line.

As described above, according to the present embodiment, input picture data can be developed in a desired direction from a desired position in a line unit by storing in advance in coordinate data storing unit 24 the write starting coordinates to video VRAM 4 and the writing direction. In other words, when the coordinate data has been set so as to write sequentially from the top downwards in coordinate data storing unit 24 as explained above, the coordinate data is flows from top to bottom. If the coordinate data has been set so as to perform writing in the opposite direction, the coordinate data flows from bottom to top. Therefore, an inverted display of the picture data can be easily generated. This may also be referred to as mirror control or mirroring. Further, when direction flags 250, 251, 252, 253, 254, 255, etc. stored in arithmetic unit control register 35 are rewritten, the picture data flows from right to left by address generator 31 generating the addresses from right to left. When the addresses are generated from left to right, the picture data also flows from left to right. Therefore, a left to right inversion (mirroring) display can be generated with ease.

It is, of course, possible to control these for each line so that these can also be applied to obtain a special effect. Further, since it is sufficient that address generator 31 generates only addresses for one line, it is not only possible to reduce the scale of the logical circuit that comprises address generator 31 but it is also possible to generate more complex addresses.

The system for executing the control data by reading the data into a line unit as described in the present embodiment can also be expanded as shown in FIG. 6. In other words, if one line is equally divided into m segments, coordinate data storing unit 24 and mask data storing unit 20 shown in FIG. 5 and FIG. 7 are provided corresponding to each line of 1/m length. To be more specific, write mask memory 2 shown in FIG. 5 and FIG. 7 is arranged by m number horizontally so that coordinate and mask data read control unit 32 reads coordinate storing unit 24 and mask data storing unit 20 in the unit of 1/m of one line to perform the processing. With the above-described arrangement, it is possible to display dynamic input data on one screen by dividing the data into m parts horizontally.

In the case of a vertical division of data, the data can be divided in one line unit by merely changing the coordinate data stored in coordinate data storing unit 24 as described above. For example, when the vertical direction is divided into p segments and horizontally into m segments, one screen of dynamic data is divided into small screens of p×m pieces and the data stored in mask data storing unit 20 is changed to allow a superimposed display of dynamic pictures on the respective small screens. In this case, coordinate and mask data read control unit 32, address initialization control unit 33 and the address generator 31 can share the processing of m times for all processing so that the display of a screen data divided into p×m small screens is made possible without an increase in the complexity of the control circuit. If p×m small screens have been combined before the dynamic data is input, under the present embodiment, a single input picture display device can be substituted for the multi-input picture display device.

Figure 8:
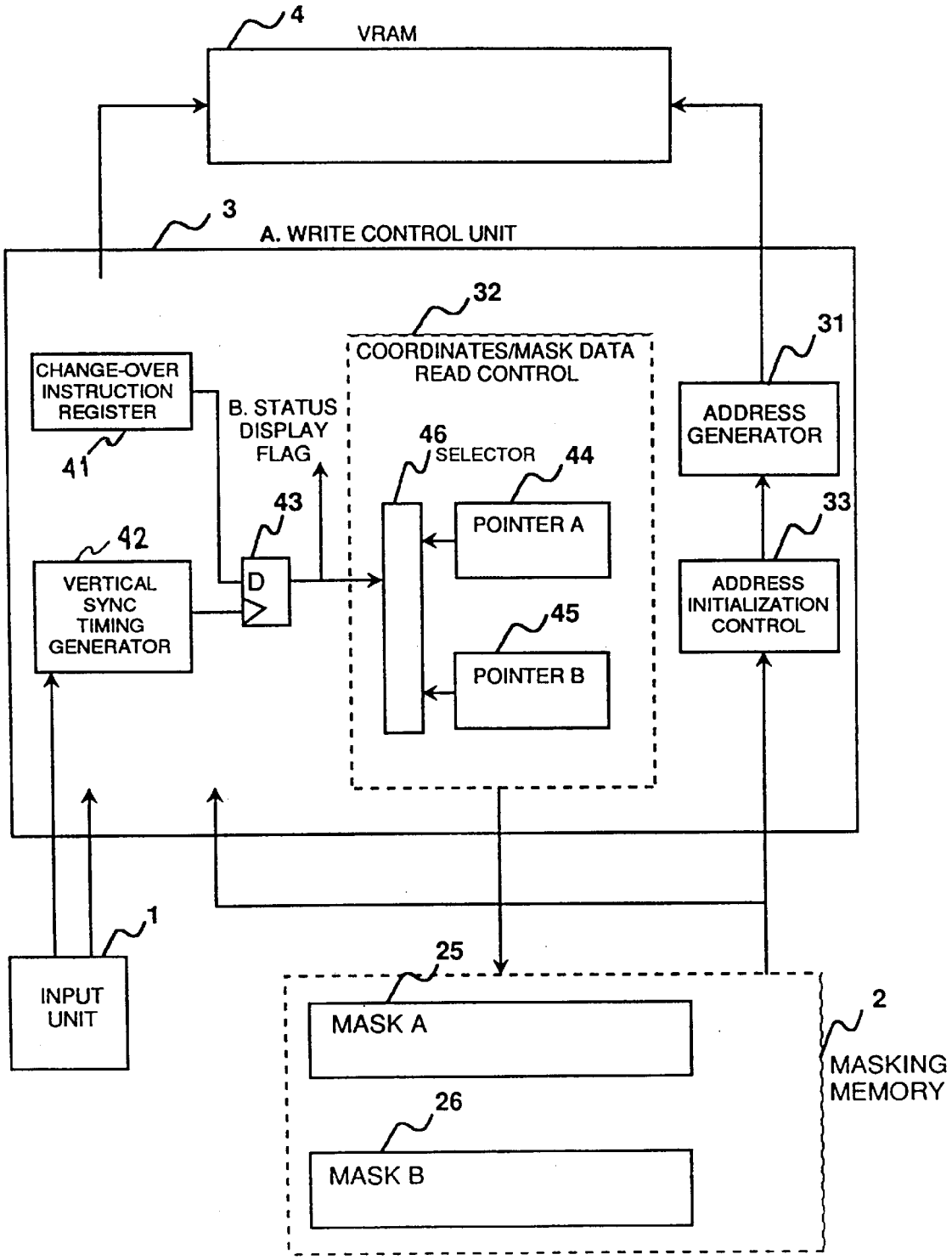
FIG. 8 is a schematic diagram of a third embodiment of the present invention.

A third embodiment of the present invention is explained next. FIG. 8 is a schematic diagram for showing the third embodiment of the present invention which has two write mask data storing units. In FIG. 8, 25 designates write mask A, 26 write mask B, and each mask may be combined with the coordinate data storing unit 20 shown in FIG. 5 and FIG. 7. Additionally, 41 designates a mask change-over instruction register, 42 a vertical timing generator, 43 a D flip-flop, 44 a pointer A for generating a reading address for write mask A 25, 45 a pointer B for generating a read address for write mask B 26, and 46 a selector for changing over between pointer A 44 and pointer B 45. The other units are the same as those having the same symbol marks in FIG. 1 to FIG. 7.

At least two write mask data memories are required. A state display flag shows the state of selector 46, which is the change-over control unit for the write mask A 25 and write mask B 26 that are the write mask data storing units. If the input video picture is being displayed by using write mask A 25 which is the first write mask data storing unit, it is possible to simultaneously write new write mask data in write mask B 26 which is another write mask data storing unit.

When the writing of the mask data is finished, change-over instruction register 41 which is a change-over instruction unit for the write mask data storing units instructs a change-over from write mask A 25 to write mask B 26. Upon receiving the instruction of the change-over given by change-over instruction register 41, selector 46 changes over between write mask A 25 and write mask B 26 based on a synchronization timing signal sent from vertical synchronization timing generator 42. The timing signal is synchronous with the vertical synchronization signal of the input dynamic picture. Thus, selector 46 changes the state of the flag. The change-over of the mask data storing units 25 and 26 is carried out immediately in synchronization with the vertical timing signal.

The detailed operation is explained next. To simplify the explanation, it is assumed that write mask information corresponding to the picture input currently displayed is set to write mask A 25 as an initial state and that the pointer A 44 is selected by change-over instruction register 41 and selector 46. It is also assumed that the state is reflected by the state display flag which is output from D flip-flop 43. When it is necessary to change the shape of the mask based on the operation by the user, a control unit such as a processor (not shown, and hereinafter to be simply referred to as a "processor") checks the state display flag of the output of D flip-flop 43. At this time write mask A 25 is active. The processor writes new mask information in write mask B 26 and, when finished, rewrites the contents of change-over instruction register 41 so that write mask B 26 is selected. The contents of change-over instruction register 41 are held until vertical synchronization timing generator 42 generates a timing signal synchronous with the vertical synchronization signal from picture data input unit 1. The generation of the timing signal synchronous with the vertical synchronization signal is needed in this case in order to allow completion of displaying one-frame or one-field of picture data in video VRAM 4. When a timing signal synchronous with the vertical synchronization signal has been generated, the contents of change-over instruction register 41 are reflected by the output of D flip-flop 43, pointer B 45 is selected by the selector 46 and the change-over to the write mask B 26 is complete. A change-over from the write mask B 26 to the write mask A 25 is also achieved by a similar procedure.

As described above, according to the present embodiment, a write mask A 25 and write mask B 26 are changed over by the timing signed synchronous with the vertical synchronization signal of the input dynamic picture. Therefore, the contents of video VRAM 4 can not be rewritten by incomplete write mask data and the motion of a dynamic picture being displayed will not be undesirably stopped.

Because of the above-described characteristics, all of the picture data can be obtained without a loss in contrast to the loss of dynamic data that occurred in the past during stopped motion. This attribute is very important, particularly in the case of picture data obtained from a broadcast program, because most of such picture data can not be retransmitted.

Figure 9:
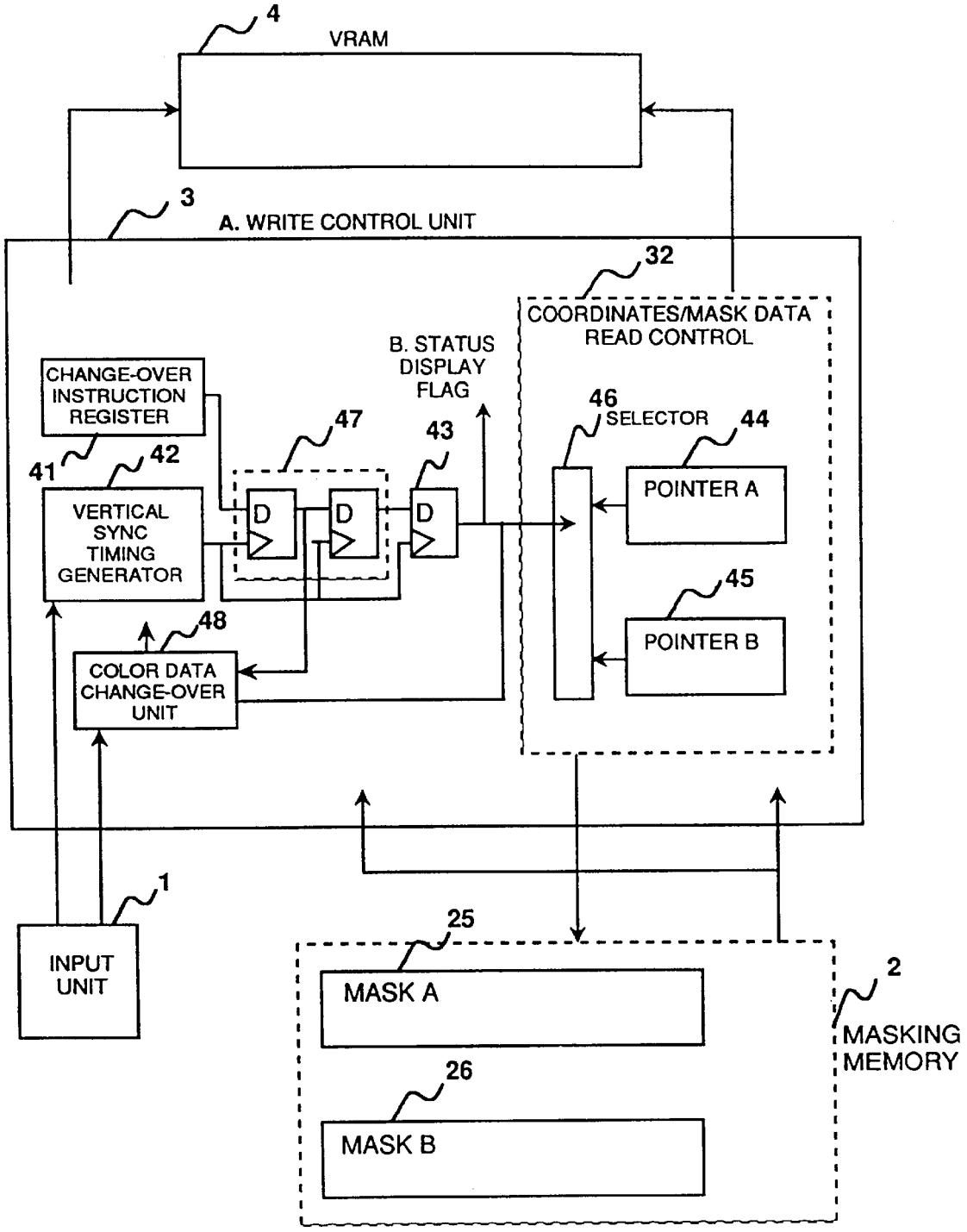
FIG. 9 is a schematic diagram of a fourth embodiment of the present invention.

A fourth embodiment of the present invention is explained next. FIG. 9 shows a schematic diagram showing the fourth embodiment of the present invention according to which picture data already written in the window by an old mask of video VRAM 4 can be deleted automatically when the write mask data is changed over. In FIG. 9, 47 designates a shift register and 48 designates a color data change-over unit for changing over between picture data from the picture data input unit 1 and specific color data. Other units are the same as those with the same symbol marks shown in FIG. 8.

At least two write mask data storing units are provided. The state display flag, showing the state of selector 46, governs which write mask data storing unit is active for display. If the write mask A 25 is in use to enable display of a picture, new mask data is written in the write mask B 26 which is another write mask data storing unit. When the writing of the write mask data is finished, change-over instruction register 41 instructs a change-over from write mask A 25 to the write mask B 26. The operation up to this stage is the same as that of FIG. 8.

Upon receiving the change-over instruction from change-over instruction register 41, selector 46 actively changes over the input dynamic data to data of a specific color after waiting for a synchronization timing signal from vertical synchronization timing generator 42. The synchronization timing signal is synchronous with the vertical synchronization signal of the input dynamic picture.

The data of the specific color (e.g., black) is the data of a color which is used to delete a picture. Selector 46 waits for a synchronization timing signal from vertical synchronization timing generator 42 to change over between write mask A 25 and mask 26 which changes the state of the state display flag. During this period, the deletion of the picture data in the area in which the dynamic data has been written is completed and therefore, the "garbage data" can be securely deleted at the moment when the write area of the dynamic picture changes.

A detailed explanation of the operation follows. To simplify the explanation, as in the case of the preceding embodiment, it is assumed that write mask information corresponding to the picture input currently displayed is set in mask A 25 and that pointer A 44 is selected by change over instructing register 41 and selector 46. It is also assumed that this status is reflected by the status display flag which is output from D flip-flop 43.

To change the shape of the mask in response to operation by the user, the processor checks the status display flag from the output of D flip-flop 43 to recognize that write mask A 25 is currently active. The processor writes new mask information to write mask B 26, and once finished, rewrites the contents of change-over instruction register 41 so that write mask B 26 is can be selected. The contents of change-over instruction register 41 are held until the timing signal synchronous with the vertical synchronization signal from the picture data input unit 1 is generated three times from the vertical synchronization timing generator 42. The generation of the timing signal synchronous with a first vertical synchronization signal is needed to allow completion of the display of the picture data of the first field in the video VRAM 4.

The signal from the intermediate tap of shift register 47, which results from the change over, is input to color data change-over unit 48. After the timing signal, which is synchronous with the vertical synchronization signal, is generated two more times, that is, after one-frame time has elapsed, the contents of change-over instruction register 41 are reflected by the output of D flip-flop 43 and pointer B 45 is selected by selector 46, which completes the change-over to mask write B 26.

As is clear from the above explanation, during the period from when the signal of the intermediate tap of the shift register 47 changes to when the signal of the status display flag output from D flip-flop 43 changes, both signals which are supplied to color data change-over unit 48 have different values. The fact that both signals have different values can be detected by an exclusive logical sum or the like. Based on the result of this detection, color data change-over unit 48 takes the data from picture input unit 1 if the values of both signals are the same, and operates to output specific color data instead of the data from picture input unit 1 if the values of both signals are different. The specific color refers to the color (e.g., black) to be used at the time of deleting the picture, as described before. Since the input of the specific color continues during the input of the picture of one frame, the area of write mask A 25 which has been used so far is completely refilled with the specific color, thus completing the deletion. A change-over from write mask B 26 to write mask A 25 can also be achieved in a similar manner.

As described above, according to the present embodiment, the picture data in the mask area in use (active) until the change-over between write mask A 25 and write mask B 26 is deleted automatically. Accordingly, the software requirements are reduced and the deletion is made in synch with the input of the picture. As a result, no unnecessary flickering occurs and the automatic deletion function is included using only an extremely small number of circuits.

Figure 10:
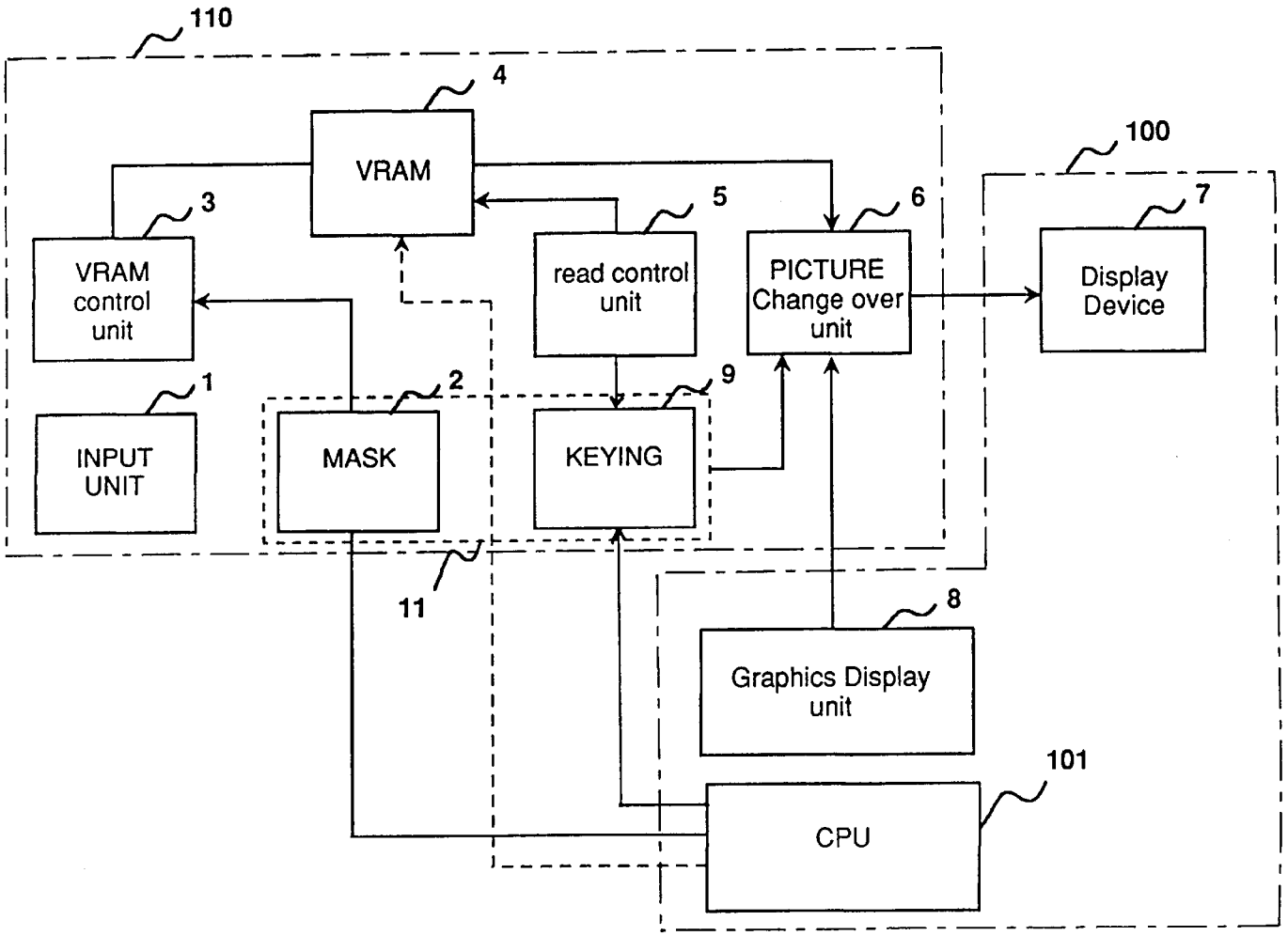
FIG. 10 is a schematic diagram of a fifth embodiment of the present invention.

Next, a fifth embodiment of the present invention is explained with reference to FIG. 10 and FIG. 11. FIG. 10 is a schematic diagram of the fifth embodiment of the present invention. In FIG. 10, 2 designates a write mask data storing memory, 9 a keying data storing memory, and 11 a keying and mask data storing memory. Other units are the same as those having the same symbol marks in FIG. 1.

The keying data is explained first. Picture change-over control unit 6 changes over between the picture data from video VRAM 4 and the graphics display data from graphics display unit 8. The keying data indicates which data should be selected at this change-over stage. The keying data is stored in keying data storing memory 9. Read control unit 5 of video VRAM 4 reads keying data storing memory 9 in synchronization with the reading of the video VRAM 4. In the present embodiment, keying data storing memory 9 and write mask data storing memory 2 are combined in keying and write mask data storing memory 11.

Normally, video VRAM 4 and keying and write mask data storing memory 11 are structured as a multi-port memory having at least a random access memory (RAM) and serial access memory (SAM). Importantly, the keying data from keying data storing memory 9 supplied to picture change-over unit 6 is transmitted through the SAM unit of keying and write mask data storing memory 11. Additionally, the masking data from write mask data storing memory 2 supplied to write control unit 3 is transmitted through the RAM unit of keying and write mask data storing memory 11. This structure allows transmission of the picture data from video VRAM 4 to picture change-over control unit 6 through the SAM unit of the video VRAM 4. With the above arrangement, write mask data storing memory 2 and keying data storing memory 9 can be shared to form the keying and write mask data storing memory 11.

Figure 11:
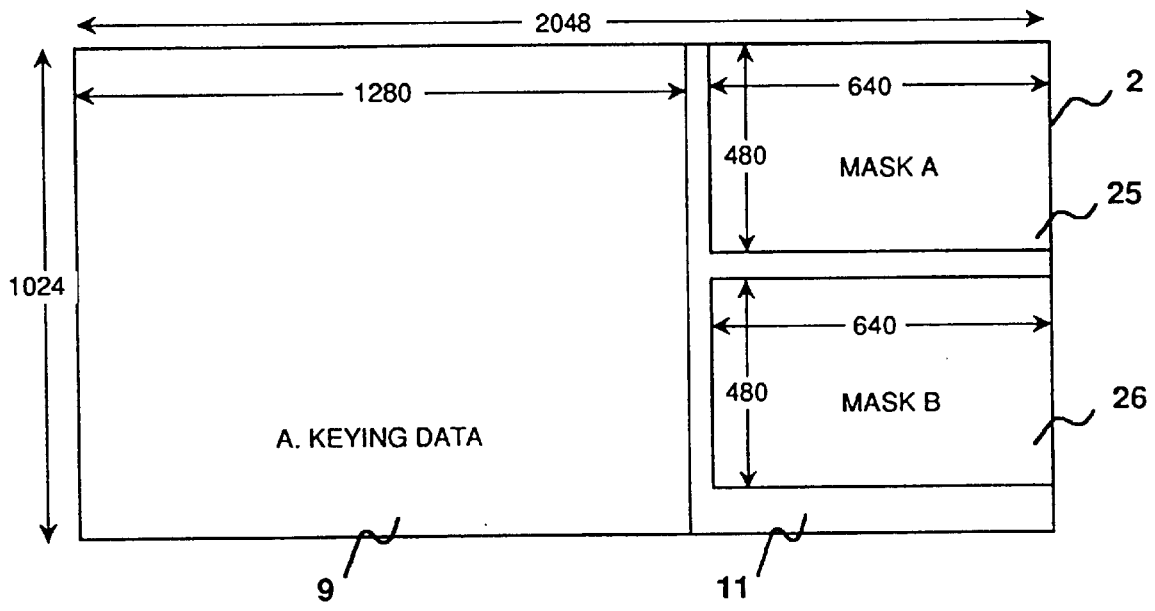
FIG. 11 is a memory schematic diagram of a shared keying and write mask data storing memories.

An example of the bit map of keying and write mask data storing memory 11 is shown in FIG. 11. Keying and write mask data storing memory 11 has a bit map of 2048×1024, of which 1280×1024 bits are used for keying data storing memory 9 with the rest for write mask data storing memory 2. Half of write mask data storing memory 2 is used for the write mask A 25 and the remaining half for write mask B 26. Normally, the memory is loaded with a value of a power of 2 such as 2048×1024. As is clear from FIG. 11, by combining with a single memory device keying data storing memory 9 and write mask data storing memory 2 the size of the memory elements are reduced. Therefore, memory is utilized in a cost effective and reduced power consumption manner.

According to the present invention, a video picture displayed on the window of the display screen can be scaled to expand and compress within the window. Particularly in the present invention, the effect of compression can be obtained. Compression scaling is achieved by thinning the pixels in the horizontal direction and thinning the horizontal lines in the vertical direction.

Figure 15:
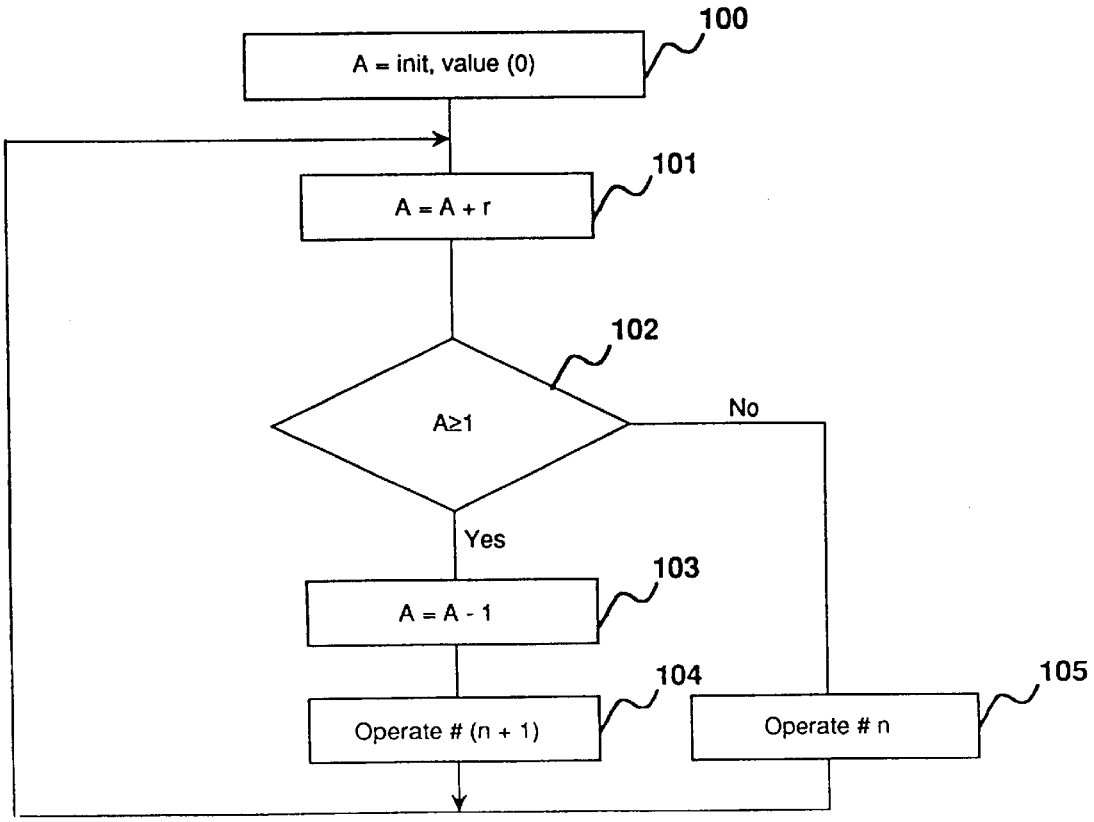
FIG. 15 is a flow chart of one example of the straight line generation algorithm.
Figure 16:
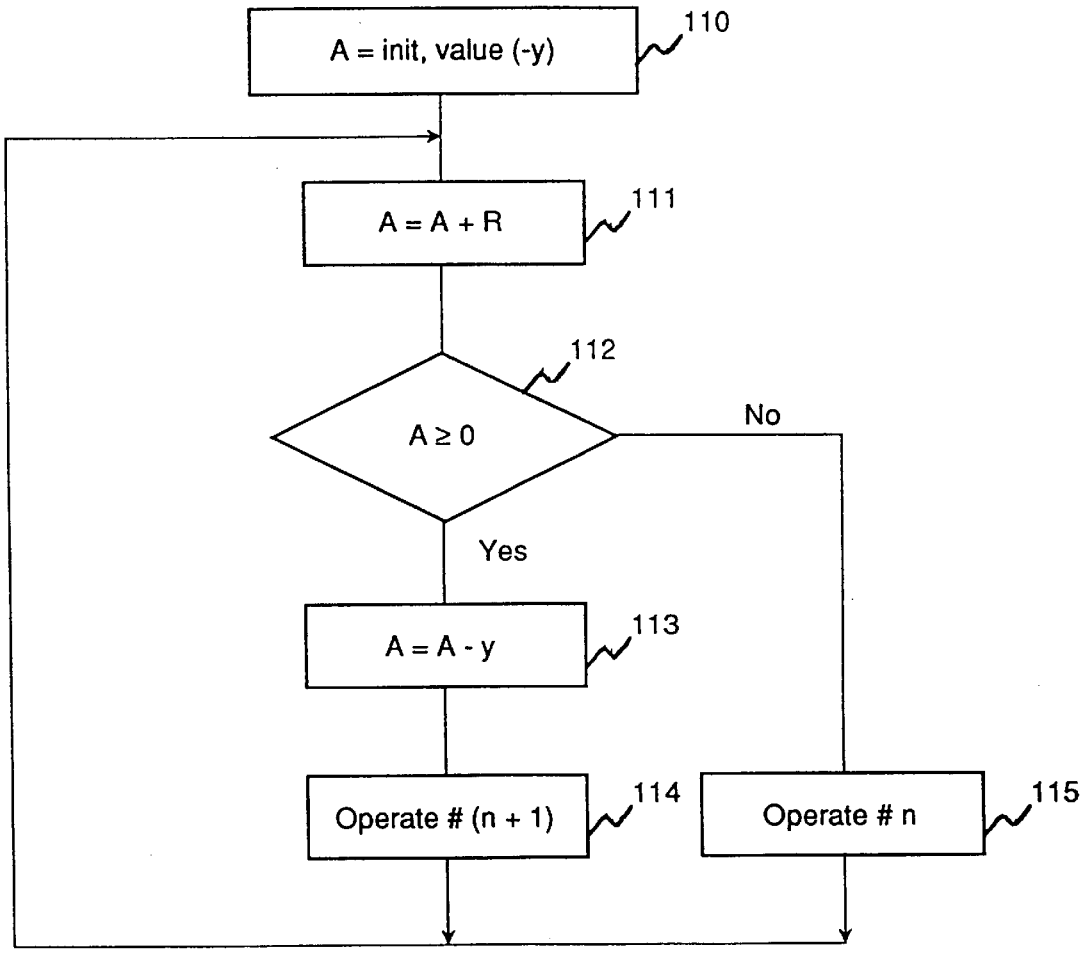
FIG. 16 is a flow chart of another example of the straight line generation algorithm.

A sixth embodiment of the present invention is explained next. In the present embodiment, the input video picture is scaled by using a line generator. The line generator of the present embodiment is characterized in that the pixels or horizontal line to be thinned is determined by using a known oblique line generation algorithm. FIG. 15 shows one example of an oblique line generation algorithm of the line generator and FIG. 16 shows another example of an oblique line generation algorithm. In FIG. 15, "A" designates an error accumulator, "n" a quotient obtained by dividing a number x of the input picture data by a number y of output data after a scale down, and "r" a remainder in this case. FIG. 15 shows the process for drawing a horizontal line component which is structured by (n+1) dots when the value of the accumulated error has exceeded 1, while if the accumulated error is less than one dot is accumulated by r, the horizontal line component structured by n dots is drawn. At initialization processing step 100, the value of error accumulator A is set to 0. At error accumulation processing step 101, the value r which shows an error of less than one dot per cycle is added to error accumulator A. At condition decision processing step 102, a decision is made whether a resultant accumulated error has exceeded 1 or not. If the accumulated error has exceeded 1, the exceeded 1 is subtracted at accumulated value correction processing step 103, and output processing of (n+1) is executed at step 104. If the accumulated error has not exceeded 1, (n) output processing is executed at step 105.

Depending on the values of x and y, the above r may become a recurring decimal and there may occur an error at the time of accumulation. The algorithm in FIG. 16 alleviates this problem in the hardware. In FIG. 16, R is calculated by multiplying r by y. The horizontal line component structured by (n+1) dots is drawn when the value of the accumulated errors in error accumulator A has exceeded y, that is, (n+1) output processing is carried out at step 114. Further, in order to simplify condition decision processing step 112, y is subtracted in advance at initialization processing step 110. With this arrangement, at condition decision processing step 112, A is not compared with y but A is compared with 0.

In summary, at initialization processing step 110, the value of error accumulator A is set to −y. At error accumulation processing step 111, the value R, which shows the error less than y (one output dot) at one time is added to error accumulator A. At condition decision processing step 112, a decision is made whether the resultant accumulated error has exceeded 0 or not. If the accumulated error has exceeded 0, the exceeded y is subtracted at the accumulated value correction processing step 113, and (n+1) output processing is carried out at step 114. If the accumulated error has not exceeded 0, (n) output processing is carried out at the step 115.

Figure 17:
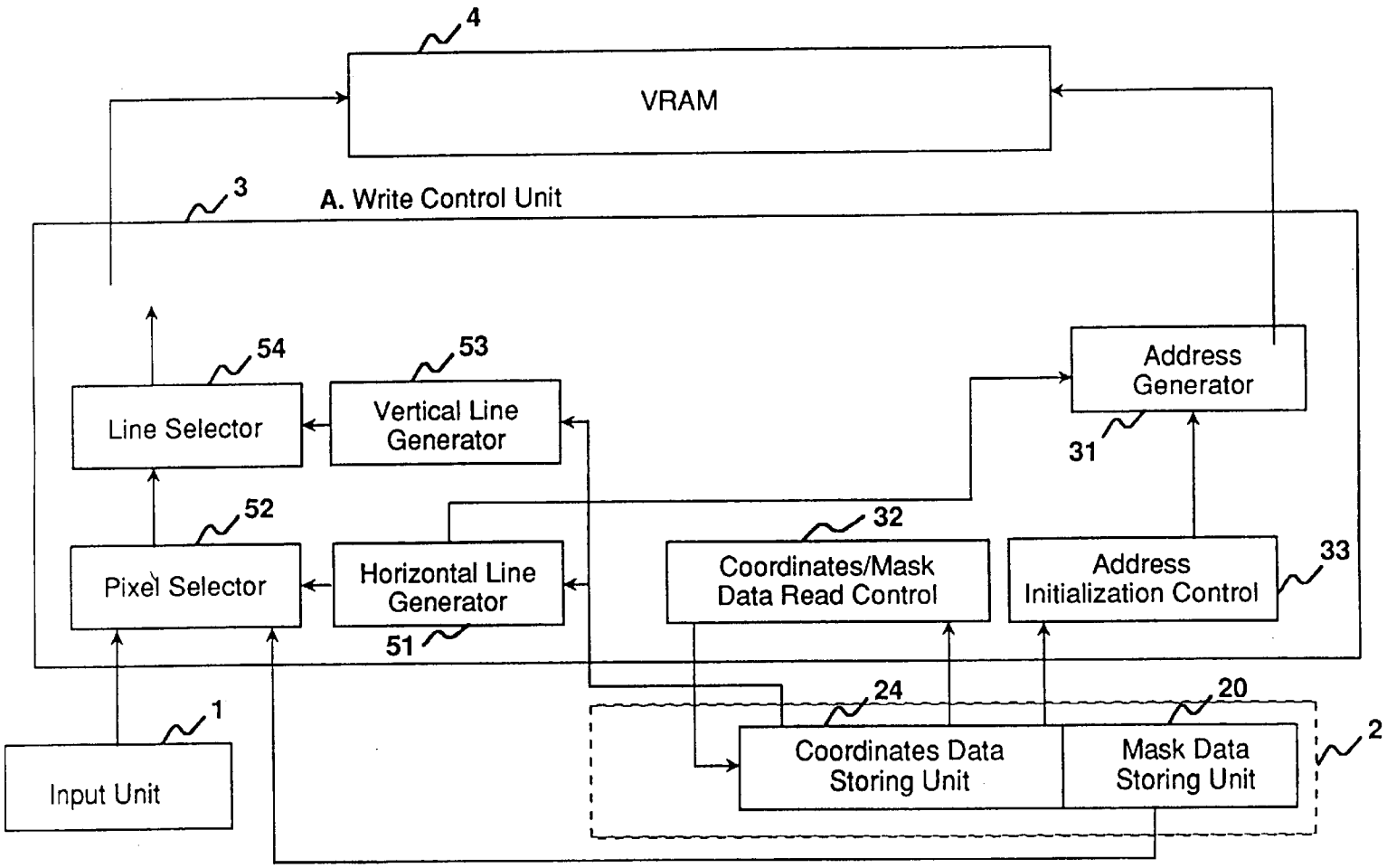
FIG. 17 is a schematic diagram of a sixth embodiment of the present invention.

FIG. 17 is a schematic diagram of the sixth embodiment of the present invention. In FIG. 17, 51 designates a horizontal line generator, 52 a pixel selector, 53 a vertical line generator, and 54 a line selector. Other units are the same as the units having the same symbol marks in FIG. 5. As described above, the compression scaling can be achieved by thinning the pixels both horizontally and vertically.

(1) Thinning of Pixels in the Horizontal Direction.

Figure 12:
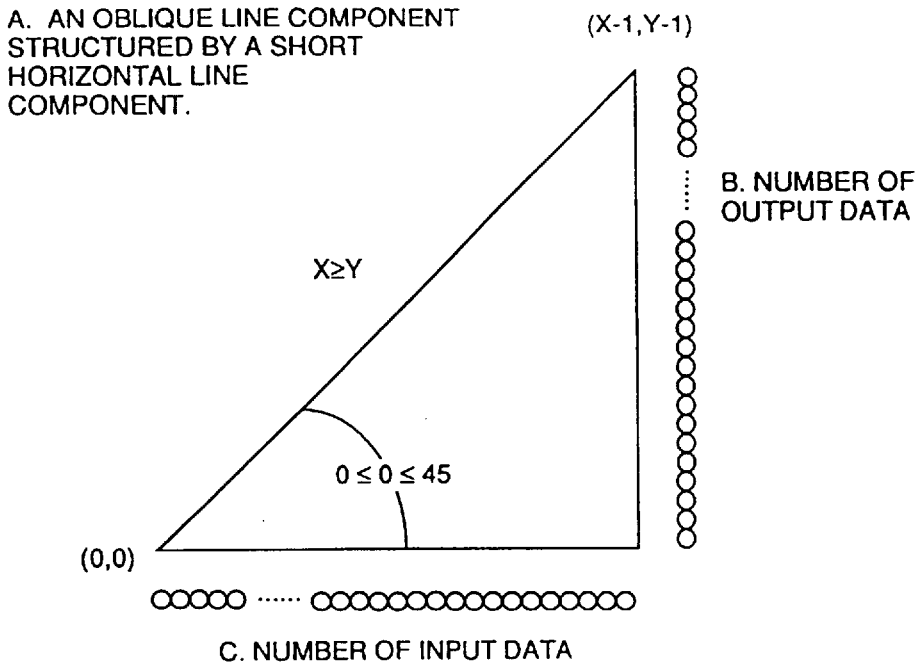
FIG. 12 depicts the scaling system to which the straight line generation algorithm is applied.

FIG. 12 depicts drawing a straight line from the origin (0, 0) to a point (x−1, y−1) in the first quadrant of an xy orthogonal coordinate system, where x and y are integers respectively and x corresponds to the number of pixels of picture input data and y corresponds to the number of pixels after compression scaling for writing into video VRAM 4. It is assumed that each dot for structuring a straight line can be drawn only at the position of an integer value on the coordinate axis.

Since compression scaling is applied, the following relationships occur: $x \geqq y$, and $0 \geqq \theta \geqq 45°$ where an angle θ is formed by the straight line and the x axis. If the straight line is drawn by using a known oblique line drawing algorithm, the straight line can be expressed as a set of y horizontal line components of at least one dot. Thus, the length of each horizontal line component represents the number of pixels of picture input data corresponding to one pixel data after the compression scaling for writing into the video VRAM. The length of individual horizontal line components may either be different or all horizontal line components may have the same length. In general, if the length of each horizontal line is expressed as n, the compression scaling in the horizontal direction can be achieved when one pixel of data is selected from the picture data of n picture inputs by using the pixel selector 52 and the selected pixel data is written in video VRAM 4.

Figure 13:
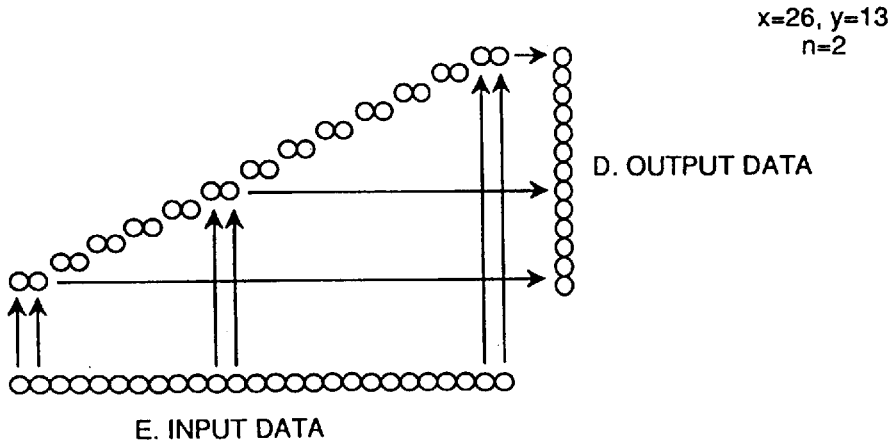
FIG. 13 depicts an example of the ½ scale down.
Figure 14:
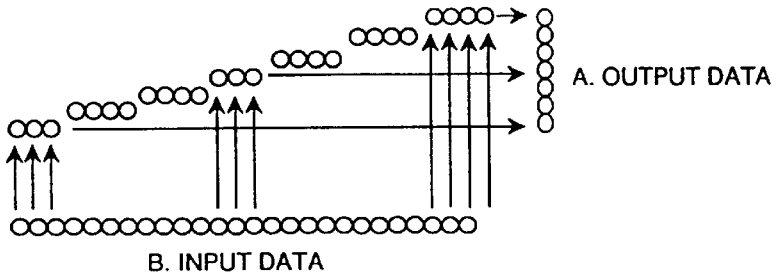
FIG. 14 depicts an example of the 7/26 scale down.

FIG. 13 shows an example of a half scale down, where it is assumed that 26 input data pixels are compressed by a half, that is, 13 input data pixels. The length n of the 13 horizontal line components for structuring the straight line becomes 2, thus one output may be selected for two input data pixels. FIG. 14 shows an example of a 7/26 scale down, which assumes that 26 input data pixels are compressed to 7 input data pixels. The length n of the 7 horizontal line components for structuring the straight line, that is, the number of pixels, becomes either 3 or 4, thus one output may be selected for three or four input data pixels. Horizontal line generator 51 generates the length n of the y horizontal line components per one line and gives this number n to pixel selector 52 and also gives address update information of the y times to address generator 31. Pixel selector 52 selects one pixel of data from the n pixel data from input unit 1 based on the given number n, and gives the selected data to next line selector 54. In selecting data, either the first data, last data or intermediate data may be selected.

(2) Thinning of Horizontal Lines in the Vertical Direction

When the scanning system sequentially scans the picture input in order from the top downwards, as the case of a non-interlace system, processing similar to the one described above is also carried out in the vertical direction. When the scanning system is an interlace system, that is skip scanning system, lines to be thinned are determined in advance by using the vertical line generator 53. The input of picture data in the horizontal unit is controlled by determining whether or not the picture data is to be written in video VRAM 4 for each horizontal line, and writing of the lines to be thinned in video VRAM 4 is prohibited. Vertical line generator 53 generates y' horizontal line components of length n' per one field as described above and gives the length n' components to line selector 54. Line selector 54 selects pixel data from one line of the pixel data of the length n' components lines from pixel selector 52 based on the given length n', and gives the selected data to video VRAM 4. In selecting lines, either the first line, last line, or intermediate lines may be selected. To write in the selected lines in video VRAM 4, the compression scaling in the vertical direction can be achieved by setting write starting coordinates so that only the selected lines can continue in the vertical direction in coordinates data storing unit 24, described in the second embodiment of the present invention.

As described above, according to the present embodiment, dynamic picture data can be scaled to a desired size so that multi-media data can be freely displayed in the window environment.

It is also good, as described in the second embodiment of the present invention, to store in advance scaling information stored as initial values necessary for horizontal line generator 51, vertical line generator 53 or pixel selector 52, in coordinates data storing unit 24 of mask data storing memory 2, and to initialize at the beginning of each line by coordinates/mask data read controlling unit 32. Particularly, line selector 54 needs only information on whether or not the current lines are necessary therefore, vertical line generator 53 can be omitted. Further, since the initial value of scaling can be changed in coordinates data storing unit 24, more complex special effects are possible, such as a trapezoidal display of a dynamic window or a mapping in an area covered by a curve. Similarly, by combining the scaling feature of the present embodiment with the split control function of small screens of p×m described in the second embodiment, it is possible to independently scale in the respective small screens. In this case, it is also possible to have a multi-function without a substantial alteration to the control circuit.

Figure 18:
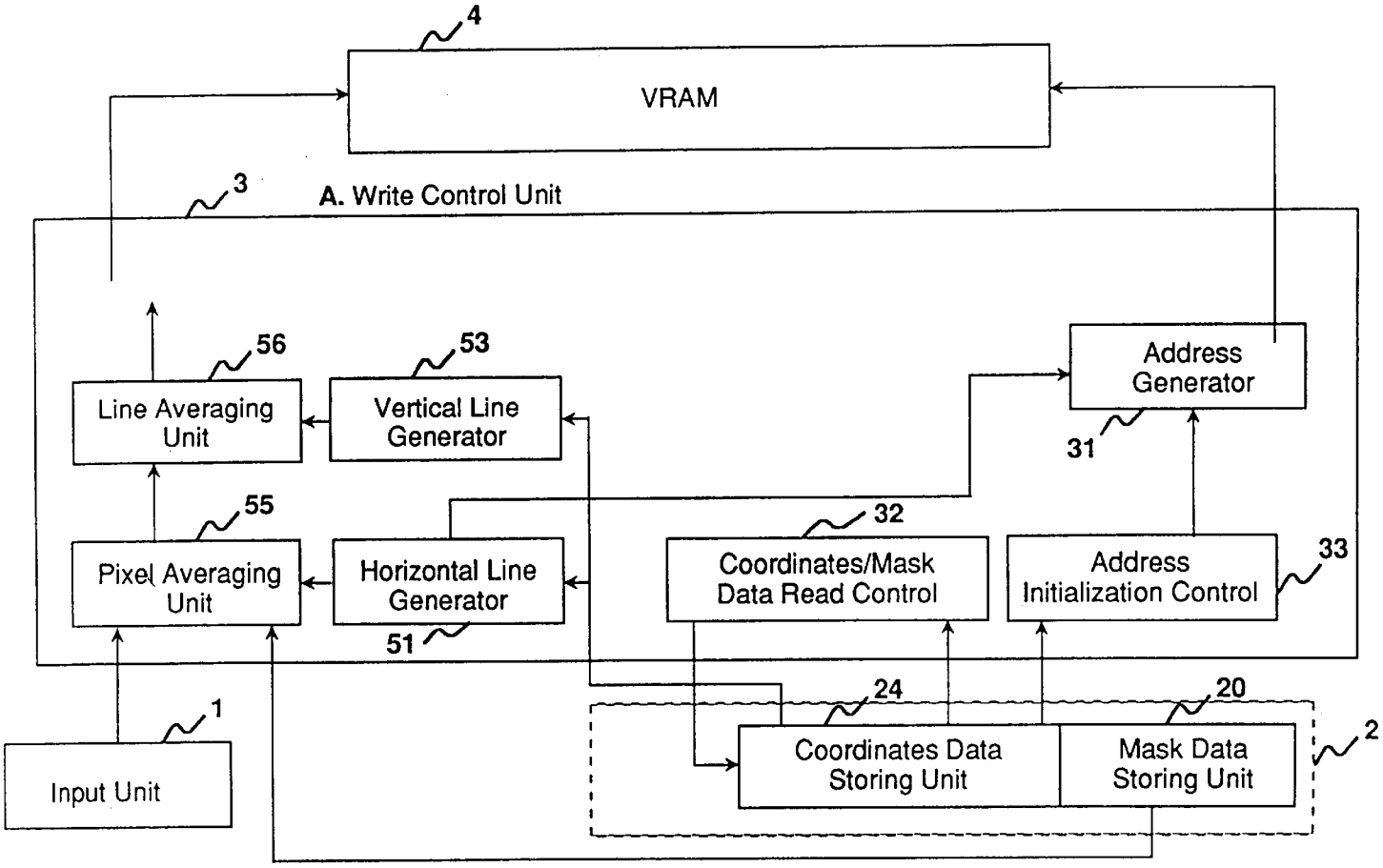
FIG. 18 is a schematic diagram of a seventh embodiment of the present invention.
Figure 19:
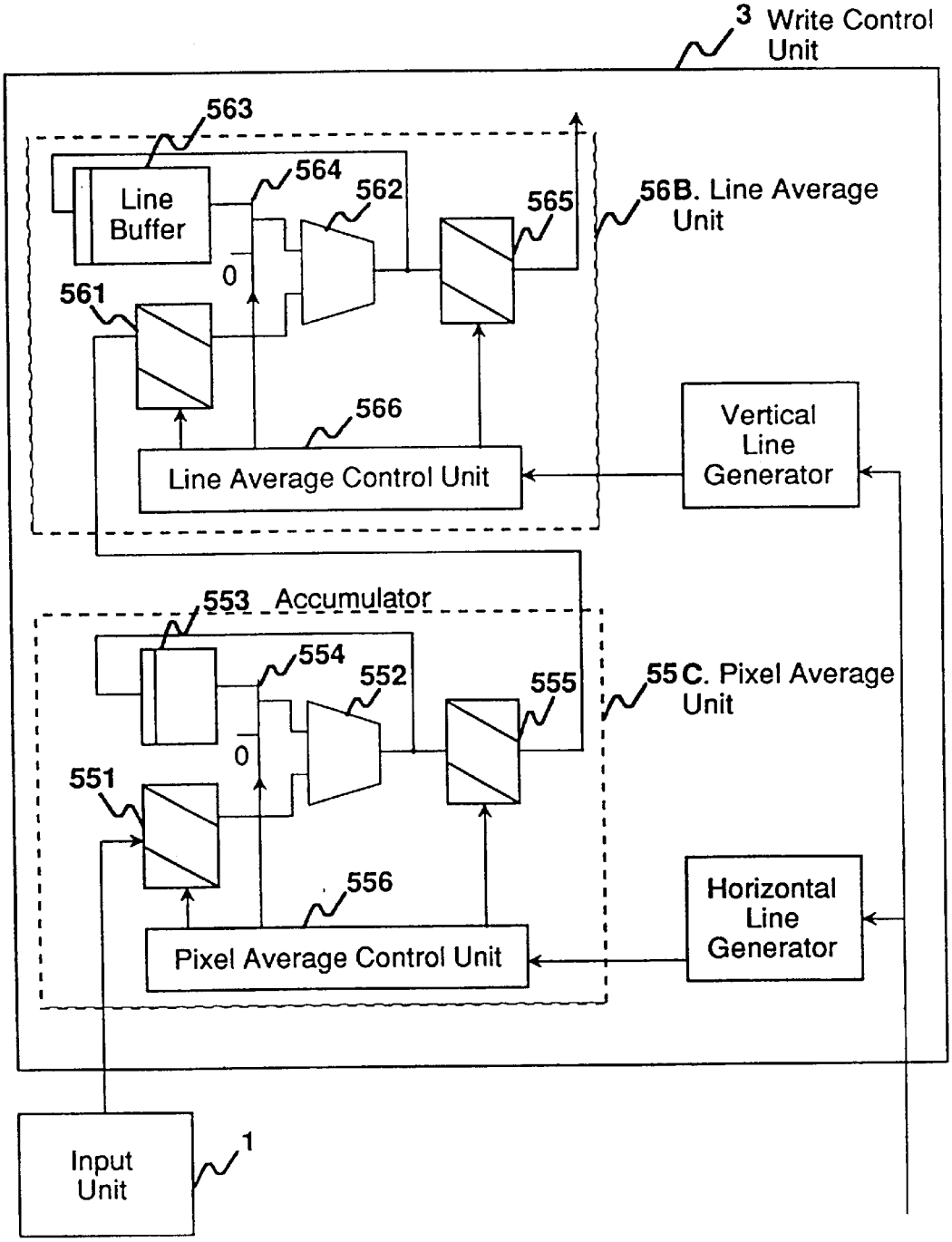
FIG. 19 is a schematic diagram of an example of the pixel and line averaging unit.

Next, a seventh embodiment of the present invention is explained with reference to FIGS. 18 to 21. In the sixth embodiment of the present invention, one pixel of data is selected from the pixel data of n pixel picture input data by using pixel selector 52 or the line selector 54 and the remaining pixel data is abandoned. In the seventh embodiment of the present invention, a picture filtering processing is utilized to mitigate the occurrence of an alias (a jaggedness in the display). In FIG. 18, 55 designates a pixel averaging unit in place of pixel selector 52 used in FIG. 7 and 56 designates a line averaging unit in place of line selector 54 used in FIG. 17. Other units are the same as those having the same symbol marks in FIG. 17. FIG. 19 is a schematic diagram showing an example of pixel averaging unit 55 and line averaging unit 56. In FIG. 19, 551 designates a pixel input weighting unit, 552 a pixel adder, 553 a register for the accumulator, 554 a pixel gate, 555 a pixel output shifter, 556 a pixel average control unit, 561 a line input weighting unit, 562 a line adder, 563 a line buffer, 564 a line gate, 565 a line output shifter, and 566 line average control unit.

(1) Picture Filtering Processing in the Horizontal Direction

For the value n outputted by horizontal line generator 51 in place of pixel selector 52, pixel averaging unit 55 arranges the pixel data of n dots of the picture input to average the n-dot pixel data of the picture input, thus performing the picture filtering processing in the horizontal direction. Horizontal line generator 51 generates the length n of y horizontal line components per one line as described above and gives the length n to pixel average control unit 556 of pixel selector 52 and, at the same time, gives address updating information of y times to address generator 31. Inside pixel averaging unit 55, pixel average control unit 556 averages the n pixel data from input unit 1 based on the given value n, and transmits the averaged result to next line averaging unit 56. In other words, pixel input weighting unit 551 multiples the input data by a weight of either one or two by using the shifter, and adder 552 adds the result to the contents of the accumulator 553, thus accumulating the values in the accumulator 553. Pixel gate 554, which transfers the initial value of accumulator 553 and is controlled by pixel average control unit 556, outputs a data value of 0 for the first pixel of the given n. Pixel average control unit 556 controls pixel input weighting unit 551 so that the sum of the weight of the accumulated values becomes a power of 2 when the accumulation of the n pixels has been finished. Pixel output shifter 555 is controlled by pixel average control unit 556 to right shift the pixel so that the weight is returned to 1 when the accumulation of n pixels is complete. With the above arrangement, the n dot pixel data of the picture input is averaged to horizontally filter the picture.

Figure 20:
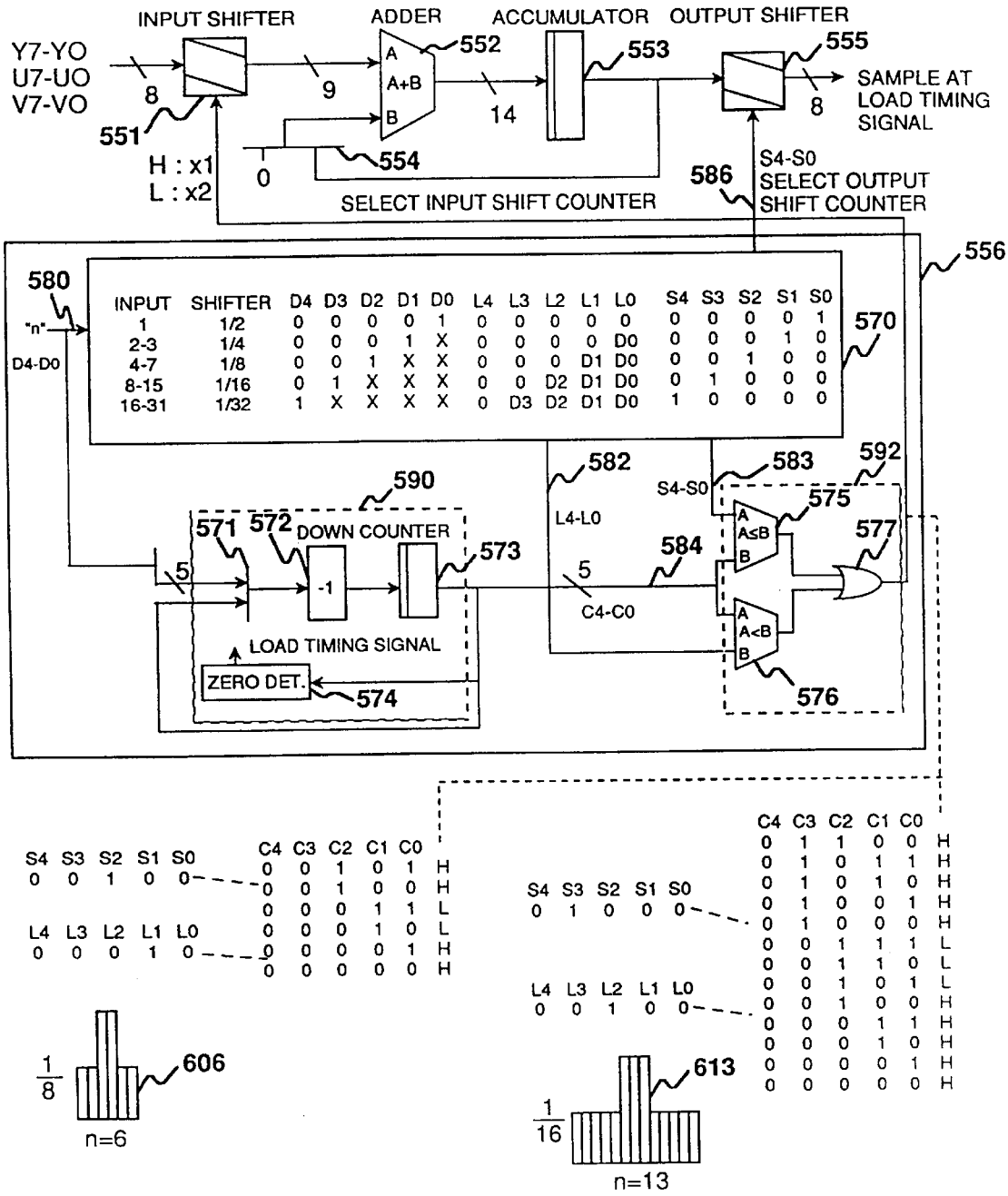
FIG. 20 is a schematic of the detailed structure of the pixel averaging unit shown in FIG. 19.
Figure 21:
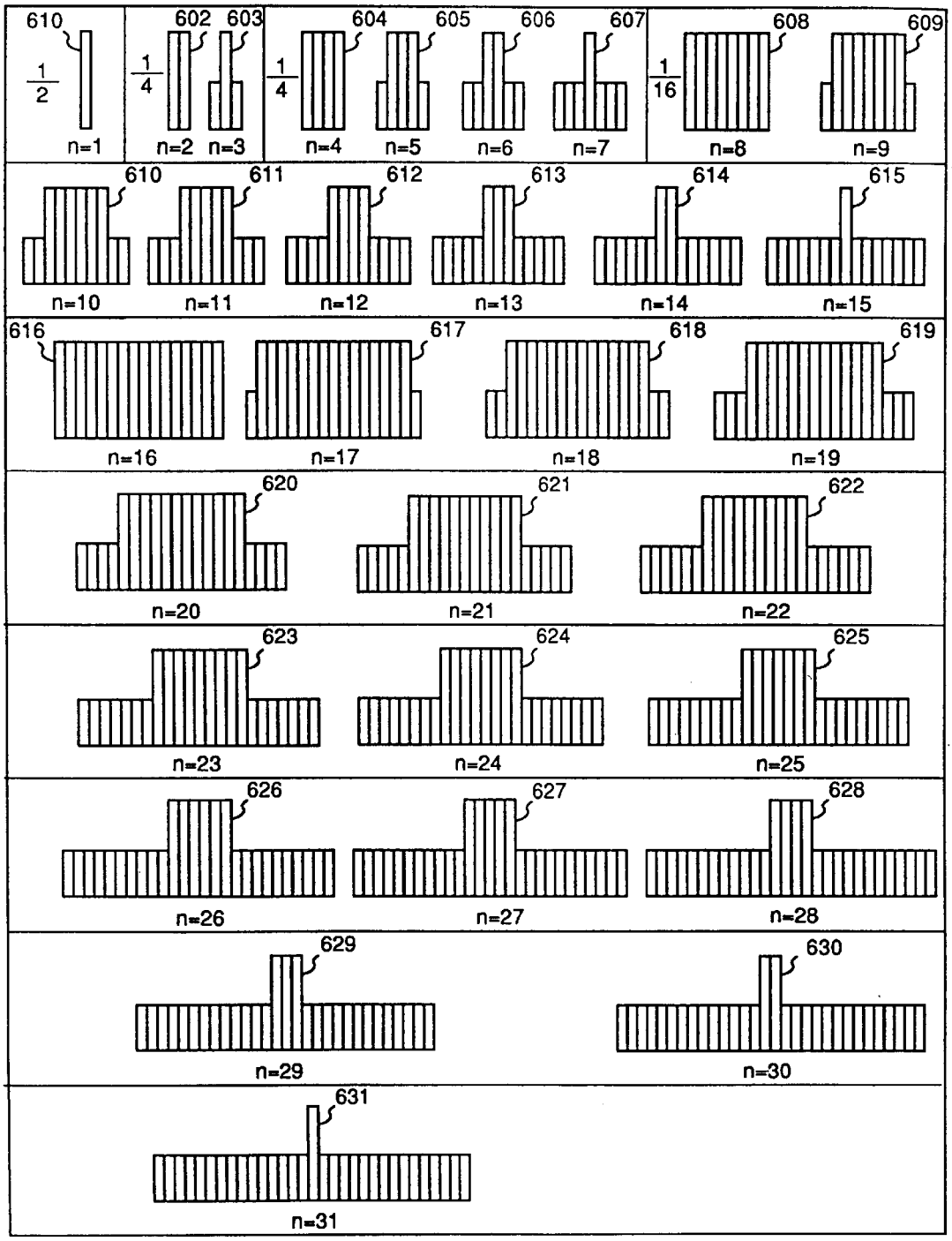
FIG. 21 depicts an example of the weighing pattern for averaging which is used in the structure shown in FIG. 20.

An alternate detailed configuration pixel average control unit 556 and of the control method is explained with reference to FIG. 20 and FIG. 21. FIG. 20 shows a schematic of pixel average control unit 556, and FIG. 21 shows the pixel average control method using the pixel average control unit depicted in FIG. 20. How pixel average control unit 556 sets the weight of the accumulated value of n input pixels to a power of 2 and how pixel output shifter 555 returns the weight to 1 is explained below where, for example, the input pixel n=6 and n=13 respectively.

In FIG. 20, 606 schematically shows how six input pixels are weighted when n=6. Six rectangles correspond to six input pixels and the height of each rectangle shows the weight. Assume that the rectangles of a smaller height represent a weight of 1 and the rectangles of a larger height represents a weight of 2. Assume that the rectangle at the right end shows the first input pixel and then the second, third, up to the sixth, thus the pixels are input from right to left. The representation shows that when n=6 (i.e., six input pixels are averaged), the weights of the input pixels are 1, 1, 2, 2, 1, 1 respectively so that the sum of the weights is 8 which is 2 to the third power, that is, $2_3$.

When n=13 and (i.e., 13 input pixels are averaged), the input pixels are weighted such that the weight of 1 is repeated five times, 2 is repeated three times then 1 is repeated five times in that order so that the sum of the weights is 16 which is 2 to the fourth power.

As described above, it is possible to put a plurality of input pixels into one set by accumulating the inputs, in particular multiplying the inputs by one or two and then by multiplying the sum by a minus power of 2. With this arrangement, it is possible to utilize a very simple hardware structure for averaging. It is assumed here that the operation of putting a plurality of input pixels into one set is expressed as averaging.

FIG. 21 depicts the weighting for n=1 (601) to n=31 (631), implementing the weighting as shown in FIG. 21. As before, all the sums become 2 to the power of some number.

The structure shown in FIG. 20 is for performing the averaging control by weighting based on the method as shown in FIG. 21. In FIG. 20, those units having the same symbol marks as those in FIG. 19 are the same units. In other words, 551 designates the pixel input weighting unit, 552 the adder, 553 the accumulator, 554 the pixel gate, 555 the pixel output shifter, and 556 the pixel average control unit. 570 designate a control signal generator, 571 a change-over unit, 572 a decrementer, 573 a register, 574 a zero detector, 575 and 576 comparators and 577 an OR gate.

Change-over unit 571, decrementer 572, register 573 and zero detector 574 constitute down-counter 590, and comparators 575 and 576 and OR gate 577 constitute window comparator 592. By loading the given value of n and down counting for each input of pixels, down-counter 590 generates n outputs from (n−1) to 0 as described later and specifies the order of the current input pixel among the total input pixels so far. Window comparator 592 generates a weight control signal 585 indicating the weight (1 or 2) of each pixel by comparing upper limit value signal line 583 supplied to comparator 575 by control signal generator 570, lower limit value signal line 582 supplied to comparator 576, and shift value control line 586 to pixel output shifter 555, based on the data value of n inputted from a signal line 580.

The table inside the block representing control signal generator 570 shows an outline of how and what signal control signal generator 570 generates each time based on the value of the data n input from signal line 580. For the sake of simplicity, it is assumed that the value of n ranges from 1 to 31 and the table shows which value each signal line takes within each range of data value n of 1, 2 to 3, 4 to 7, 8 to 15, and 16 to 31. Numbers in the shifter column show fractions into which each value accumulated in the accumulator 553 for each value range is finally shifted by picture output shifter 555 (reference FIG. 21). D4 to D0 show the n values expressed in binary numbers and x represents wither 0 or 1 depending on the value of n. S4 to S0 which represent upper value signal lines 583 are the values of only the highest order 1 from D4 to D0 which represent signal lines 580. One of ordinary skill in the art can easily produce these values from D4 to D0 by using a common technique known as a priority encoding. L4 to L0 which represent lower limit value signal lines 582 are the highest order 1 of D4 to D0 changed to 0, and these values can be generated by carrying out an exclusive logical sum of D4 to D0 and S4 to S0. By comparing the necessary shift values shown in the shifter column with the values S4 to S0, reveals these values correspond to each other by 1 to 1. Therefore, a person of ordinary skill in the art can easily understand that S4 to S0 can be used as is or shift value control lines 586 can be generated with some conversion.

The order of operations when n is 6 is explained below. When n is 6, D4 to D0 become "00110" and S4 to S0 of upper limit value signal lines 583 become "00100" because only the highest order 1 of D4 to D0 is taken out. L4 to L0 of lowest limit value signal lines 582 become "00010" because the highest order 1 of D4 to D0 is changed to 0. Further, based on the values of S4 to S0, shift value control lines 586 outputs values which make pixel output shifter 555 shift by ⅛. When the initial value of register 573 at down-counter 590 is 0, zero detector 574 detects 0 and causes change-over unit 571 to input the value of n "00110" to decrementer 572. Then decrementer 572 outputs to register 573 the value "00101" which is the result of the input n deducted by 1. After this value is loaded in register 573 and the output values of C4 to C0 of register 573 become "00101", the zero detector 574 causes change-over unit 571 to input the output values of register 573 to decrementer 572. Thereafter, down counting is continued until the output values of C4 to C0 of register 573 are 0. This state is shown in C4 to C0.

Next, comparator 575 of window comparator 592 compares S4 to S0 of upper limit signal lines 583 (the value in this case is "00100") with the outputs C4 to C0 of register 573 and outputs HIGH during the first two pixels period. Further, comparator 576 compares L4 to L0 of lower limit signal lines 582 (the value in this case is "00010") with the outputs C4 to C0 of register 573 and outputs HIGH during the last two pixels period. The results are logically summed by OR gate 577, and LOW is output during the intermediate two pixels period during which comparators 575 and 576 do not output HIGH. With the above arrangement, the desired weight control signal 585 is generated when n is 6.

The order of operations when n is 13 is explained below. The operations are very similar to the case of n=6 described above, thus, the below explanation is simplified. When n is 13, D4 to D0 become "01101" and S4 to S0 of upper limit value signal lines 583 become "01000". L4 to L0 of lowest limit value signal lines 582 become "00101". Further, based on the values of S4 to S0, shift value control lines 586 output values which make pixel output shifter 555 shift by 1/16. When the initial value of register 573 at down-counter 590 is 0, decrementer 572 outputs the value "01100" which is the result of the input value n deducted by 1. After this value is loaded in register 573, down counting is continued until the output values of C4 to C0 of register 573 become 0. This state is shown in C4 to C0. Next, comparator 575 compares S4 to S0 of upper limit value signal lines 583 (the value in this case is "01000") with the outputs C4 to C0 of register 573 and outputs HIGH during the first five pixels period. Further, comparator 576 compares L4 to L0 of lower limit value signal lines 582 (the value in this case is "00101") with the outputs C4 to C0 of the register 573 and outputs HIGH during the last five pixels period. The results are logically summed by OR gate 577, and LOW is output during the intermediate three pixels period during which comparators 575 and 576 do not output HIGH. With the above arrangement, the desired weight control signal 585 is generated when n is 13.

Based on the above-described procedures, it will be easily understood that the pixel average control unit 556 can generate desired control signal groups when n is other than 6 or 13.

(2) Vertical Picture Filtering Processing

Line averaging unit 56 averages the pixel data included in a plurality of lines and achieves vertical picture filtering processing. The operation is the same as the above-described processing in the horizontal direction except that the processing is in line unit. When averaging the pixel data based on n' from vertical line generator 53, line input weighting unit 561 weights each line for each data of the n' lines for which the above-described horizontal picture filtering processing has been completed. Line adder 562 stores the accumulation result in line buffer 563. Line gate 564 prevents the data from line buffer 563 from being input to line adder 562 for the first line of the n' lines to compress. In accumulating the n'-th line for compression, the accumulation is performed so that the sum of the weighting becomes 2 to the power of some number, and the accumulation is controlled by line output shifter 565 so that the weight is ultimately returned to 1. The result is written in video VRAM 4 by using write control unit 3, thus achieving pixel data averaging both horizontally and vertically.

As described above, according to the present embodiment, scaling is possible while carrying out the picture filtering processing of the input dynamic data in desired sizes, thus multi-media data can be displayed in high quality in the window environment.

Further, as described in the sixth embodiment of the present invention, it is also good to initialize each line by coordinates/mask data read control unit 32 by storing in advance the initial values which are necessary for horizontal line generator 51, vertical line generator 53 or the line averaging unit 56 in coordinates data storing unit 24 of write mask data storing memory 2. Particularly, line averaging unit 56 requires only information indicating whether the current lines are necessary and information indicating the input weighting coefficient and line buffer output coefficient, so that vertical line generator 53 can be omitted and line average control unit 566 can be replaced by a simple register. Further, since the initial value of the scaling can be changed in the line storage unit, more complex special effects are possible, such as a trapezoidal display of the dynamic window or a mapping in the area encircled by a curve. Similarly, in combination with the p×m small screen split control function as described in the second embodiment, scaling can be carried out independently while performing the picture filtering in the small screen unit. A multi-function can also be obtained in this case without a substantial change in the control circuit.

Figure 22:
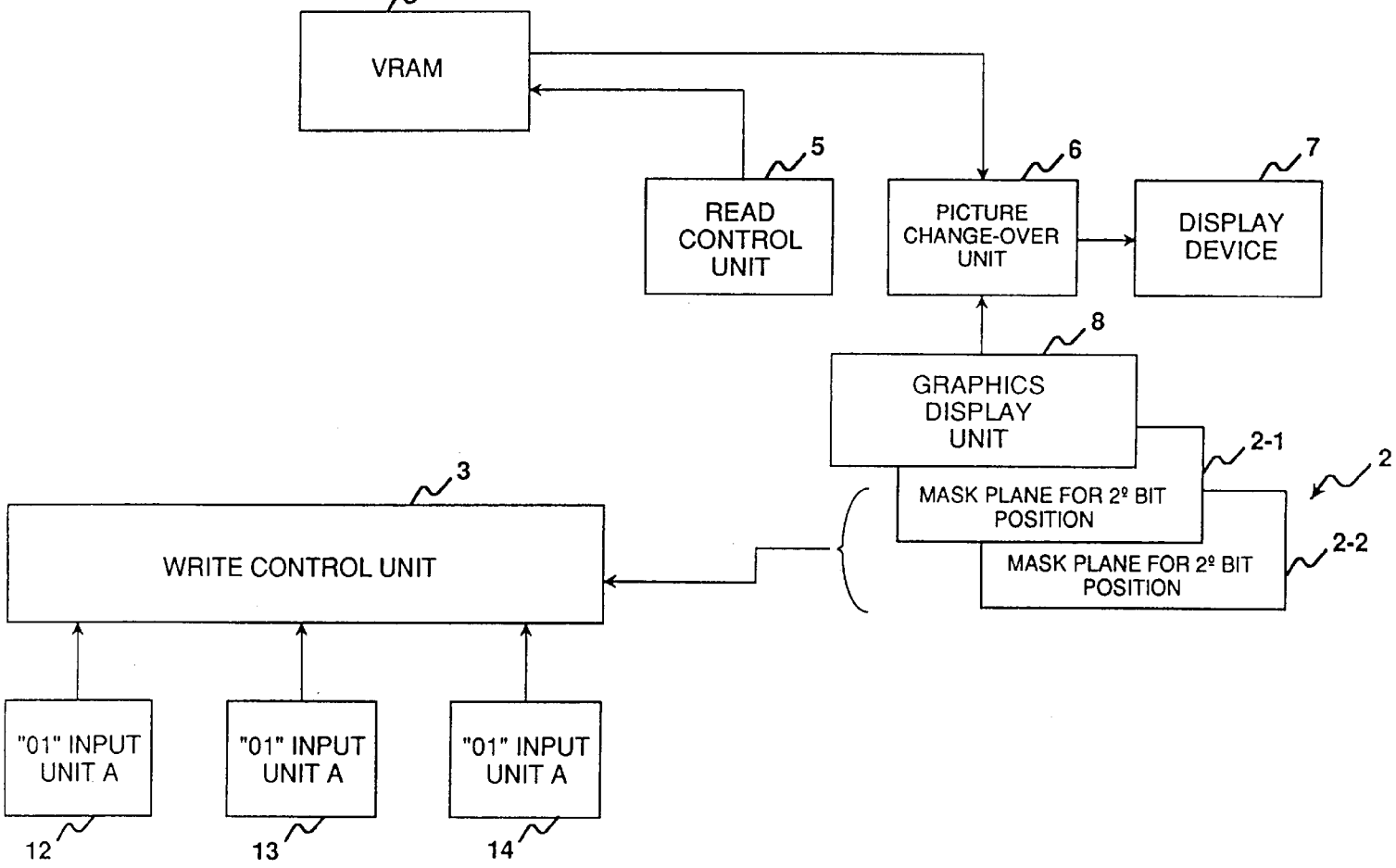
FIG. 22 is a schematic diagram of an eighth embodiment of the present invention.

An eighth embodiment of the present invention is explained next with reference to FIG. 22. FIG. 22 is a schematic diagram of the eighth embodiment of the present invention. Referring to FIG. 22, three video pictures of picture data input unit A 12, picture data input unit B 13 and picture data input unit C 14 are input. Although the number of the input video pictures is shown as three in the present embodiment, the present invention can be applied to any desired number of at least two input video pictures. 2' designates a write mask data storing memory having a 2-bit depth, and this write mask data storing memory has a mask plane 2-1 for storing write mask data of a first bit position and a mask plane 2-2 for storing write mask data of a second bit position. Other units are the same as those units having the same symbol marks shown in FIG. 1. Video VRAM 4', the mask planes 2-1 and 2-2 each have bit numbers corresponding to the number of pixels of display screen 70 of display device 7.

In write mask data storing memory 2', having the same bit map as that of the graphics VRAM 4' and having a depth of a plurality bits, one of the multiple picture input numbers is written, as in the case of the color display in the conventional graphics VRAM. For example, it is possible to express four ways in a write masking memory having a 2-bit depth and 256 ways in a write masking memory having an 8-bit depth. Normally, one way is allocated to the graphics display and no allocation is made to correspond to any picture data input for video VRAM 4'. Accordingly, the maximum number of picture data input units that can be handled in write mask data storing memory 2' having the n-bit depth becomes 2 to the power of n-1. In the multiple picture data input units 12–14, picture input numbers are defined exclusively in the respective picture data inputs corresponding to each picture data input unit. For example, the input unit A 12 has "01", the input unit B 13 has "10" and the input unit C 14 has "11", in the binary unit. "00" is allocated to the graphics within graphics display unit 8. Input picture displayed at what position on the display screen within computer main body 100 is determined by assigning the picture input number in 2 bits using two mask planes for each pixel on the display screen. CPU 101 within computer main body 100 writes in advance the write mask data in two mask planes 2-1 and 2-2 as in the case of the preceding embodiments.

Video write control unit 3 reads write mask data storing memory 2' corresponding to the coordinates of video VRAM 4' into which the input pixel,data is to be written. Coincidence between the picture input number defined in the picture data input units and the contents of write mask data storing memory 2' is detected. If the defined picture input number coincides with the contents of write mask data storing memory 2', video VRAM write control unit 3 writes the picture data in video VRAM 4. It is only necessary to fill in the square window area with the data of the picture input number in write mask data storing memory 2' just like drawing a window in the conventional graphics VRAM. At most, one number can be written in one pixel component area of mask data storing memory 2', so that a plurality of pictures will never be written at the same position of video VRAM 4 if the number of a dynamic picture input is defined exclusively.

Therefore, according to the present embodiment, it is possible to display a dynamic picture window by merely drawing in the write mask data storing memory the number data of the dynamic picture input to be displayed, in the manner similar to that of the conventional graphics drawing. As a result, the operator can manipulate the window display without being conscious about the dynamic window.

From the above description, it will be apparent that the invention disclosed herein provides a novel and advantageous video picture display device and method for controlling video picture display. The foregoing discussion discloses and describes merely exemplary methods and embodiments of the present invention. One skilled in the art will readily recognize from such discussion that various changes, modifications and variations may be made therein without departing from the spirit and scope of the invention. Accordingly, the disclosure of the present invention is intended to be illustrative, but not limiting, of the scope of the invention which is set forth in the following claims.

What is claimed is:

1. The write mask control system for Video data capture system or display system comprising:

control memory containing the following data as a control data block for at least each scan line:

write start address, write mask data;

and a controller which reads the control data block from the control memory, comprising:

a write address generator which generates a write address from the initial said write start address, and a write control means that controls the video data to either write or not write according to said write mask data.

2. The write mask control system for Video data capture system or display system according to claim 1, with said control data block further comprising:

scaling information.

3. The write mask control system for Video data capture system or display system according to claim 2, with said control data block further comprising:

write direction control data for the mirror control.

4. The write mask control system for Video data capture system or display system according to claim 3 with said control data block further comprising:

dividing the incoming video stream into multiple windows controlled by the write mask control data where the write mask control data allows independent control of the multiple windows; where such a scheme allows each incoming video line to be broken up into several window sections where the write mask control data allows each window section to be independently masked, routed, scaled and mirrored.

5. The write mask control system for Video data capture system or display system according to claim 3, where the incoming video data consists of scan lines which contain either displayable data or data containing information, such as close caption information: the write start address scheme of addressing allows the scan lines containing information data to be routed either to system memory or Video memory or both by setting the write start address associated with each scan line to the appropriate value, in addition the scan lines containing display data are allowed to be routed either to system memory or Video memory or both by setting the write start address associated with each scan line to the appropriate value.

6. The write mask control method for Video data capture system or display system according to claim 3, where the incoming video data contains interlaced scan lines forming even and odd field video, this write start address scheme of addressing allows one video data field to be routed to either system memory or Video memory by setting each write start address for each scan line of the field to either the system address or the Video memory address and the other field of display data routed to either Video memory or system memory by setting each write start address for each scan line of the field to Video memory or system memory.

7. The write mask control system for Video data capture system or display system according to claim 2, with said control data block further comprising:

dividing the incoming video stream into multiple windows controlled by the write mask control data where the write mask control data allows independent control of the multiple windows; where such a scheme allows each incoming video line to be broken up into several window sections where the write mask control data allows each window section to be independently masked, routed, scaled and mirrored.

8. The write mask control system for Video data capture system or display system according to claim 2, where the incoming video data consists of scan lines which contain either displayable data or data containing information, such as close caption information: the write start address scheme of addressing allows the scan lines containing information data to be routed either to system memory or Video memory or both by setting the write start address associated with each scan line to the appropriate value, in addition the scan lines containing display data are allowed to be routed either to system memory or Video memory or both by setting the write start address associated with each scan line to the appropriate value.

9. The write mask control method for Video data capture system or display system according to claim 2, where the incoming video data containing interlaced scan lines forming even and odd field video, this write start address scheme of addressing allows one video data field to be routed to either system memory or video memory by setting each write start address for each scan line of the field to either the system address or the Video memory address and the other field of display data routed to either Video memory or system memory by setting each write start address for each scan line of the field to Video memory or system memory.

10. The write mask control system for Video data capture system or display system according to claim 1, with said control data block further comprising:

dividing the incoming video stream into multiple windows controlled by the write mask control data where the write mask control data allows independent control of the multiple windows; where such a scheme allows each incoming video line to be broken up into several window sections where the write mask control data allows each window section to be independently masked, routed, scaled and mirrored.

11. The write mask control system for Video data capture system or display system according to claim 10, where the incoming video data consists of scan lines which contain either displayable data or data containing information, such as close caption information: the write start address scheme of addressing allows the scan lines containing information data to be routed either to system memory or Video memory or both by setting the write start address associated with each scan line to the appropriate value, in addition the scan lines containing display data are allowed to be routed either to system memory or Video memory or both by setting the write start address associated with each scan line to the appropriate value.

12. The write mask control method for Video data capture system or display system according to claim 10, where the incoming video data contains interlaced scan lines forming even and odd field video, this write start address scheme of addressing allows one video data field to be routed to either system memory or Video memory by setting each write start address for each scan line of the field to either the system address or the Video memory address and the other field of display data routed to either Video memory or system memory by setting each write start address for each scan line of the field to Video memory or system memory.

13. The write mask control system for Video data capture system or display system according to claim 1, where the incoming video data consists of scan lines which contain either displayable data or data containing information, the write start address scheme of addressing allows the scan lines containing information data to be routed either to system memory or Video memory or both by setting the write start address associated with each scan line to the appropriate value, in addition the scan lines containing display data are allowed to be routed either to system memory or Video memory or both by setting the write start address associated with each scan line to the appropriate value.

14. The write mask control system for Video data capture system or display system according to claim 1, where the incoming video data contains interlaced scan lines forming even and odd field video, this write start address scheme of addressing allows one video data field to be routed to either system memory or video memory by setting each write start address for each scan line of the field to either the system address or the video memory address and the other field of display data routed to either Video memory or system memory by setting each write start address for each scan line of the field to Video memory or system memory.

15. The write mask control method for Video data capture system or display system comprising:

creating a control data block in control memory where the control data block contains the following for at least each scan line:

write start address, write mask data;

and providing steps for a controller to read the control data block from the control memory as follows:

(a) read the write start address and use to set an address generator to an initial value, (b) the initialized address generator then generates write addresses in a predetermined manner, (c) which in turn allows the writing of the video data to address indicated by the write address generator if the write mask data so indicates, else the video data is not written to the indicated address and is thus masked.

16. The write mask control method for Video data capture system or display system according to claim 15, further comprising a step of:

(d) creating scaled video data as generated by step (c) according to scaling information found in control data block.

17. The write mask control method for Video data capture system or display system according to claim 16, further comprising a step of:

(e) using the write direction control data in the control data block to decide the write direction used to generate the write address at step (b).

18. The write mask control system for Video data capture system or display system according to claim 16, where steps are taken to create a control data block further comprising:

a method to divide each scan line of the incoming video stream into multiple windows controlled by the write mask control data where the write mask control data provides a means to independently control the multiple windows; where the method of creating the write mask control data allows each window section to be independently routed, scaled and mirrored.

19. The write mask control method for Video data capture system or display system according to claim 16;

providing a method whereby the incoming video data, which consists of scan lines containing either displayable data or data containing information, such as close caption information, is separated into several streams with the write start address addressing scheme; this allows one stream, the information data stream, to be routed to either system memory or Video memory by taking steps to set the write start address for each scan line of the information data stream to either the system address or Video memory address and allows the display data to be routed to either Video memory or system memory by taking steps to write start address for each scan line of display data to either Video memory or system memory.

20. The write mask control method for Video data capture system or display system according to claim 16;

providing a method whereby the incoming video data, where the incoming video data contains interlaced scan lines forming even and odd field video, allows the fields to be routed to separate places with this write start address addressing scheme, steps are provided where one video data field is routed to either system memory or Video memory by taking steps to set the write start address for each scan line of the field to either the system address or Video memory address and the other field of display data is routed to either Video memory or system memory by taking steps to set the write start address for each scan line in the other field to either the Video memory or system memory.

21. The write mask control method for Video data capture system or display system according to claim 15, further comprising a step of:

(e) using the write direction control data in the control data block to decide the write direction used to generate the write address at step (b).

22. The write mask control method for Video data capture system or display system according to claim 21, where the steps are taken to create a control data block further comprising:

a method to divide each scan line of the incoming video stream into multiple windows controlled by the write mask control data where the write mask control data provides a means to independently control the multiple windows; where the method of creating the write mask control data allows each window section to be independently routed, scaled and mirrored.

23. The write mask control method for Video data capture system or display system according to claim 21;

providing a method whereby the incoming video data, which consists of scan lines containing either displayable data or data containing information, such as close caption information, is separated into several streams with the write start address addressing scheme; this allows one stream, the information data stream, to be routed to either system memory or Video memory by taking steps to set the write start address for each scan line of the information data stream to either the system address or Video memory address and allows the display data to be routed to either Video memory or system memory by taking steps to write start address for each scan line of display data to either Video memory or system memory.

24. The write mask control method for Video data capture system or display system according to claim 21;

providing a method whereby the incoming video data, where the incoming video data contains interlaced scan lines forming even and odd field video, allows the fields to be routed to separate places with this write start address addressing scheme, steps are provided where one video data field is routed to either system memory or Video memory by taking steps to set the write start address for each scan line of the field to either the system address or Video memory address and the other field of display data is routed to either Video memory or system memory by taking steps to set the write start address for each scan line in the other field to either the Video memory or system memory.

25. The write mask control method for Video data capture system or display system according to claim 15, where steps are taken to create a control data block further comprising:

a method to divide each scan line of the incoming video stream into multiple windows controlled by the write mask control data where the write mask control data provides a means to independently control the multiple windows; where the method of creating the write mask control data allows each window section to be independently routed, scaled and mirrored.

26. The write mask control method for Video data capture system or display system according to claim 25;

providing a method whereby the incoming video data, which consists of scan lines containing either displayable data or data containing information, such as close caption information, is separated into several streams with the write start address addressing scheme; this allows one stream, the information data stream, to be routed to either system memory or Video memory by taking steps to set the write start address for each scan line of the information data stream to either the system address or Video memory address and allows the display data to be routed to either Video memory or system memory by taking steps to write start address for each scan line of display data to either Video memory or system memory.

27. The write mask control method for Video data capture system or display system according to claim 25;

providing a method whereby the incoming video data, where the incoming video data contains interlaced scan lines forming even and odd field video, allows the field to be routed to separate places with this write start address addressing scheme, steps are provided where one video data field is routed to either system memory or Video memory by taking steps to set the write start address for each scan line of the field to either the system address or Video memory address and the other field of display data is routed to either Video memory or system memory by taking steps to set the write start address for each scan line in the other field to either the Video memory or system memory.

28. The write mask control method for Video data capture system or display system according to claim 15;

providing a method whereby the incoming video data, which consists of scan lines containing either displayable data or data containing information, such as close caption information, is separated into several streams with the write start address addressing scheme; this allows one stream, the information data stream, to be routed to either system memory or Video memory by taking steps to set the write start address for each scan line of the information data stream to either the system address or Video memory address and allows the display data to be routed to either Video memory or system memory by taking steps to write start address for each scan line of display data to either Video memory or system memory.

29. The write mask control method for Video data capture system or display system according to claim 15;

providing a method whereby the incoming video data, where the incoming video data contains interlaced scan lines forming even and odd field video, allows the fields to be routed to separate places with this write start address addressing scheme, steps are provided where one video data field is routed to either system memory or Video memory by taking steps to set the write start address for each scan line of the field to either the system address or Video memory address and the other field of display data is routed to either Video memory or system memory by taking steps to set the write start address for each scan line in the other field to either the Video memory or system memory.

* * * * *